US007121082B2

(12) United States Patent
Nakagawa et al.

(10) Patent No.: US 7,121,082 B2
(45) Date of Patent: Oct. 17, 2006

(54) ENGINE CONTROL SYSTEM

(75) Inventors: Shinji Nakagawa, Tokyo (JP); Minoru Ohsuga, Tokyo (JP); Mamoru Nemoto, Tokyo (JP); Kosaku Shimada, Tokyo (JP); Toshio Hori, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 102 days.

(21) Appl. No.: 10/687,812

(22) Filed: Oct. 20, 2003

(65) Prior Publication Data

US 2004/0211171 A1 Oct. 28, 2004

(30) Foreign Application Priority Data

Apr. 25, 2003 (JP) ..... 2003-120860

(51) Int. Cl.
*F01N 3/00* (2006.01)

(52) U.S. Cl. ..... 60/285; 60/297; 60/301; 701/103; 701/109

(58) Field of Classification Search ..... 60/285, 60/286, 295, 297, 301; 701/103, 109, 114
See application file for complete search history.

(56) References Cited

U.S. PATENT DOCUMENTS 5,771,686 A * 6/1998 Pischinger et al. ..... 60/274
5,894,725 A * 4/1999 Cullen et al. ..... 60/274
6,167,695 B1 * 1/2001 Itou et al. ..... 60/274
6,167,696 B1 * 1/2001 Maaseidvaag et al. ..... 60/274
6,347,512 B1 * 2/2002 Kolmanovsky et al. ..... 60/274
6,422,003 B1 * 7/2002 Ament et al. ..... 60/278
6,460,328 B1 * 10/2002 Hertzberg ..... 60/285
2002/0026790 A1 3/2002 Shimotani et al.

FOREIGN PATENT DOCUMENTS

EP 1 270 911 A1 1/2003
JP 11-229853 8/1999
JP 2000-337131 12/2000
JP 2001-271679 10/2001

* cited by examiner

*Primary Examiner*—Binh Q. Tran
(74) *Attorney, Agent, or Firm*—Crowell & Moring LLP

(57) ABSTRACT

In a lean-burn engine equipped, in the exhaust pipe, with NOx trap catalyst that collects NOx by absorption or occlusion, the rich spike start timing and rich spike volume are optimized.

The above subject is achieved by an engine control system equipped, in the downstream side of the NOx trap catalyst, with a NOx sensor that detects the NOx component in the exhaust, NOx trap catalyst model, and a device that controls the engine operating condition based on the outputs of the NOx trap catalyst model and NOx sensor.

12 Claims, 28 Drawing Sheets

< FUEL INJECTION QUANTITY COMPUTING SECTION >

< FUEL INJECTION QUANTITY CORRECTING SECTION >

ENGINE CONTROL SYSTEM

BACKGROUND OF THE INVENTION

The present invention relates to an exhaust emission control system of a combustion engine, particularly to an engine control system for exhaust purification of a lean-burn engine combustable at a wide air-fuel ratio.

The lean-burn engine has attracted its attention as the needs for fuel-efficient engines increase. The lean-burn engine is generally equipped with a NOx trap catalyst in the exhaust pipe for purifying NOx during lean operation. The NOx trap catalyst has the following functions, that is, a function which traps NOx in an oxidation atmosphere (at the time of lean operating), and a function which releases and reduces NOx in a reduction atmosphere by HC and CO contained in exhaust emission from the engine (at the time of rich operating).

Accordingly, in order to decrease NOx in the exhaust, it is important to utilize the NOx catalyst efficiently, and to optimize both the timing for changing to a reduction atmosphere (the timing for starting a rich spike) and the amount of reduction agents (rich spike amount) to be supplied. According to the prior arts, the following inventions are proposed. For example in Japanese Application Patent Laid-Open Publication No. 2001-271679, a NOx sensor is provided in the downstream of the NOx catalyst to detect the termination time of the rich spike.

In Japanese Application Patent Laid-Open Publication No. Hei 11-229853, and Japanese Application Patent Laid-Open Publication No. 2000-337131, a NOx sensor is provided in the downstream of the NOx catalyst to diagnose degradation of the NOx catalyst.

SUMMARY OF THE INVENTION

Any of the above prior arts, however, does not provide means for optimizing the rich spike start timing and rich spike amount.

The present invention provides an engine system equipped with the device for optimizing the rich spike start timing and rich spike volume.

The fundamental composition of the present invention is shown in claim 1 and FIG. 1.

The engine control system comprises the following matters, that is, a NOx trap catalyst (A) provided in the exhaust pipe (B) of the engine (F) to trap NOx by absorption or storage (occlusion) in an oxidation atmosphere and emit NOx in a reduction atmosphere;

a NOx sensor (C) located in the downstream of the NOx trap catalyst (A) to detect NOx components in exhaust;

a NOx trap catalyst model (D) for estimating a NOx amount trapped in the NOx trap catalyst (A); and a device (E) that controls the operating condition of the engine (F) based on outputs of the NOx trap catalyst model (D) and the NOx sensor (C).

According to the present invention, the condition of the NOx catalyst, particularly the NOx trap amount, is computed precisely by using the NOx trap catalyst model. Thereby, it is possible to control the operating condition of the engine so as to start the rich spike just before the trapped NOx is saturated. Consequently the fuel efficiency and exhaust of the engine are optimized. In addition, an optimum rich spike amount is provided based on the NOx trap amount. By the way, there is some possibility that an error of the NOx trap catalyst model results from the dispersion of the NOx trap catalyst characteristic due to product difference of mass-produced engines and variation per hour (aging). In order to cope with the model error, a NOx sensor is provided in the downstream of the NOx trap catalyst, and the model error is corrected based on the output of the NOx sensor. By providing both NOx trap catalyst model and NOx sensor as above, both rich spike start timing and rich spike volume can be optimized.

The subordinate concepts of the present invention are shown in FIG. 2–7. The engine control system of FIG. 2 and claim 6, in addition to the composition of claim 1, is equipped with a tuning device (G). The device tunes the parameter (the NOx trap ratio e.g.) obtained at the NOx trap catalyst model based on the output of the NOx sensor by using online.

According to the present invention, the model error (the error of the NOx trap catalyst model), which results from the dispersion of the NOx trap catalyst characteristic due to product difference of mass-produced engines and aging, is tuned based on the out put of the NOx sensor by using online. Thereby, it is possible to perform an optimum control based on the precise model all the time.

The engine control system of FIG. 3 and claim 2, in addition to the composition of claim 1, is equipped with the following estimate device. The device estimates a NOx amount trapped in the NOx trap catalyst and a NOx amount in the downstream of the NOx trap catalyst based on exhaust components in the upstream of the catalyst, an exhaust temperature and an air flow rate.

The NOx trap amount trapped by the NOx trap catalyst and the NOx amount in the downstream of the NOx trap catalyst equivalent to a non-trapped NOx amount are computed by the NOx trap catalyst model, because they are necessary for the optimization of the rich spike timing and rich spike amount. In order to compute them more precisely, the exhaust components in the upstream of the catalyst, the exhaust temperature and the air flow rate are used as the information inputted into the NOx trap catalyst model.

The engine control system of FIG. 4 and claim 7 is constituted based on the composition of FIG. 3. The system is equipped with a rich spike starting control device (H) and a logic element (I) as the engine operating condition device. The device (H) starts the rich spike control when the NOx trap amount in the NOx trap catalyst, which is computed by the NOx trap 20, catalyst model, or the output of the NOx sensor exceeds a specified value.

According to the composition of FIG. 4, the NOx trap catalyst model computes the NOx trap amount. And the model can judge whether the catalyst became saturated with the trapped NOx by using the specified value as a judgment standard, and obtain the optimum rich spike start timing. Thereby, because the lean operation continues until the NOx catalyst is saturated with the trapped NOx, both fuel efficiency (fuel consumption) and exhaust can be optimized. Besides, because there is a possibility that the NOx trap catalyst computes with error, in consideration of such a case, the engine control system copes with it as follows. The NOx in the downstream of the NOx trap catalyst is detected by the NOx sensor. When the detected NOx exceeds the specified value, the rich spike is started by the device (H) even when the NOx trap amount estimated by the model does not exceed the specified value. Thereby the present invention can improve the precision of the control of the fuel consumption and exhaust.

The engine control system of FIG. 5 and claim 8 is constituted based on the composition of FIG. 1. The system is equipped with a device (J) for the rich spike amount and the rich time as the engine operating condition device. The device (J) determines the rich amount or rich time required for the rich spike based on the NOx trap amount in the NOx trap catalyst estimated by the NOx trap catalyst model.

According to the composition of FIG. 5, the NOx trap catalyst model (D) estimates the trapped NOx precisely. And HC and CO necessary for reducing the NOx in the rich spike operation is supplied neither too much nor too less by determining of the device (J). Thereby, the exhaust of NOx, HC and CO can be minimized.

The engine control system of FIG. 6 and claim 2, in addition to the composition of FIG. 1, is equipped with the following estimate device (K). The device (K) estimates the NOx trap amount or the NOx trap ratio based on the NOx amount detected in the downstream of the NOx trap catalyst during the rich spike.

The NOx trapped in the catalyst is reduced into $N_2$ by HC and CO during the rich spike operation, while a part of NOx is not reduced and exhausted. The cause is regarded as resulting from mainly insufficiency of the reducing agent and reaction probability. Therefore, if the amount of reducing agent supplied and reaction probability are known, it becomes possible to estimate the NOx amount trapped by detecting the non-reduced NOx with the NOx sensor (C) in the downstream of the catalyst. The device (K) performs the estimation based on detected value of the NOx sensor.

The engine control system of FIG. 7 and claim 10 is constituted based on the composition of FIG. 6. In the system, the parameter (e.g. NOx trap ratio) representing a NOx trap capacity is provided in the NOx trap catalyst model (D). The tuning device in the model (D) adjusts the parameter based on the estimated NOx trap amount.

According to the composition of FIG. 7, since the NOx trap amount can be computed precisely by online with the NOx trap amount estimate device (K), the NOx trap capacity in the NOx trap catalyst model (D) can be adjusted based on the information of the NOx trap amount, and engine system can be controlled based on the precise model.

DESCRIPTION OF THE PREFFERRED EMBODIMENTS (Embodiment 1)

The preferred embodiment of the present invention is described according to FIG. 8–24. In this embodiment, an engine control system according to claims 1, 3, 4 is described hereunder.

Figure 1:
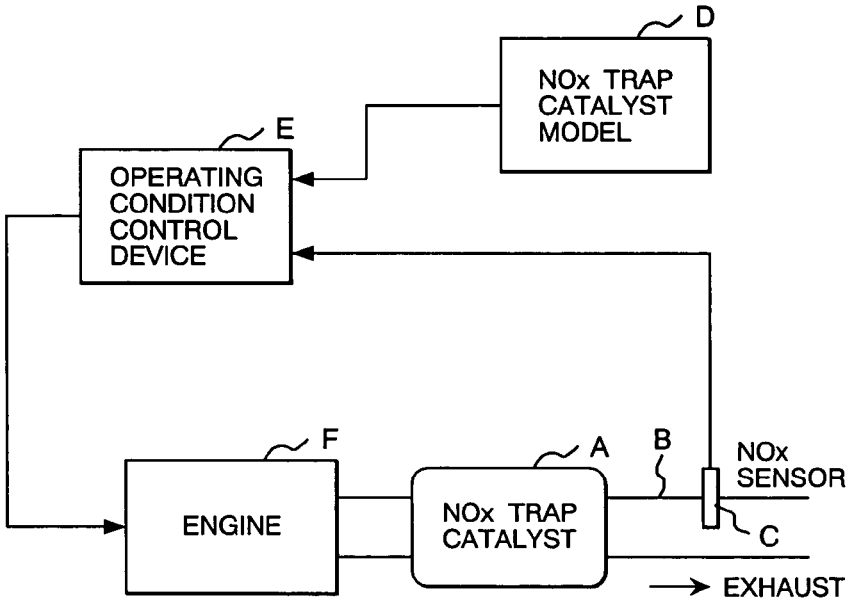
FIG. 1 is a Diagram showing the engine control system according to claim 1.
Figure 2:
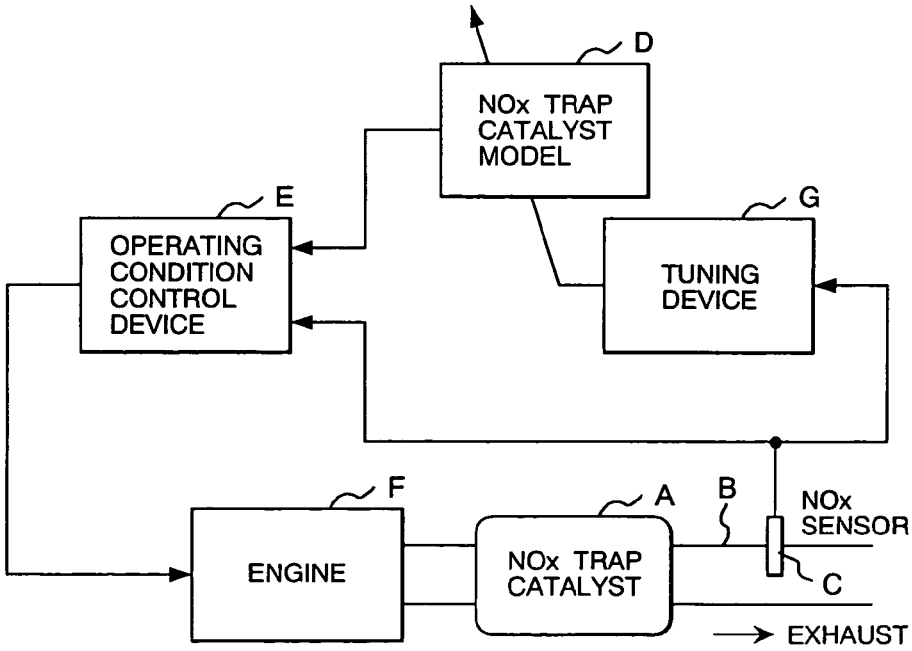
FIG. 2 is a Diagram showing the engine control system according to claim 6.
Figure 3:
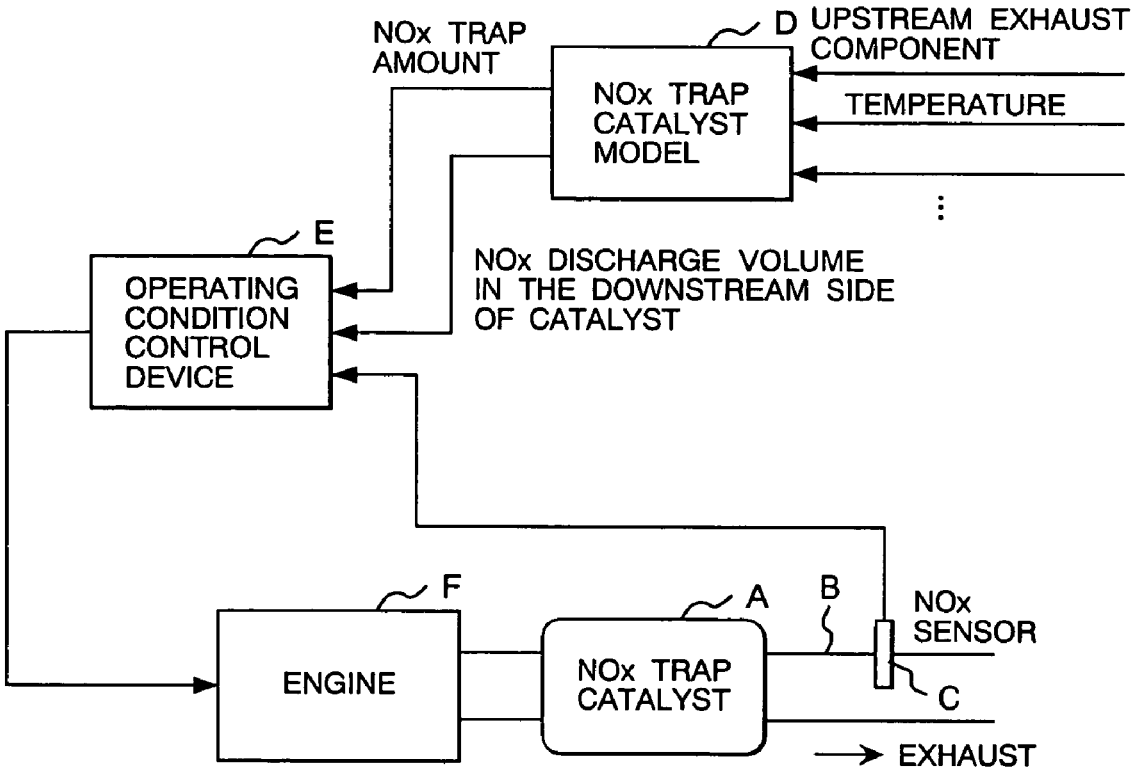
FIG. 3 is a Diagram showing the engine control system according to claim 2.
Figure 4:
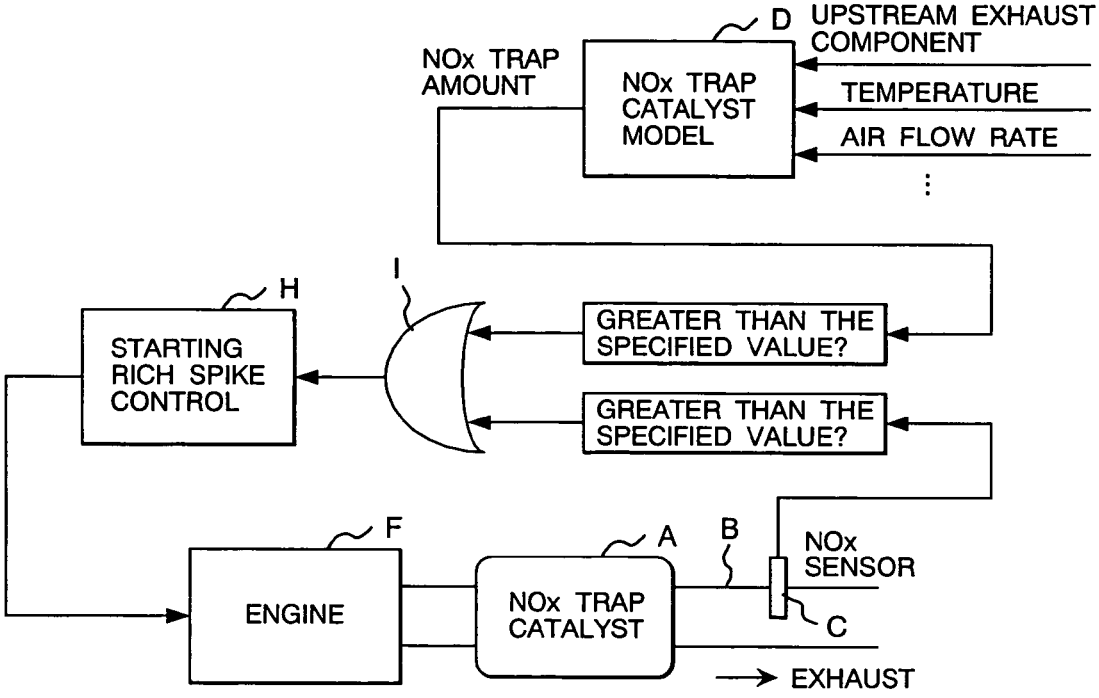
FIG. 4 is a Diagram showing the engine control system according to claim 7.
Figure 5:
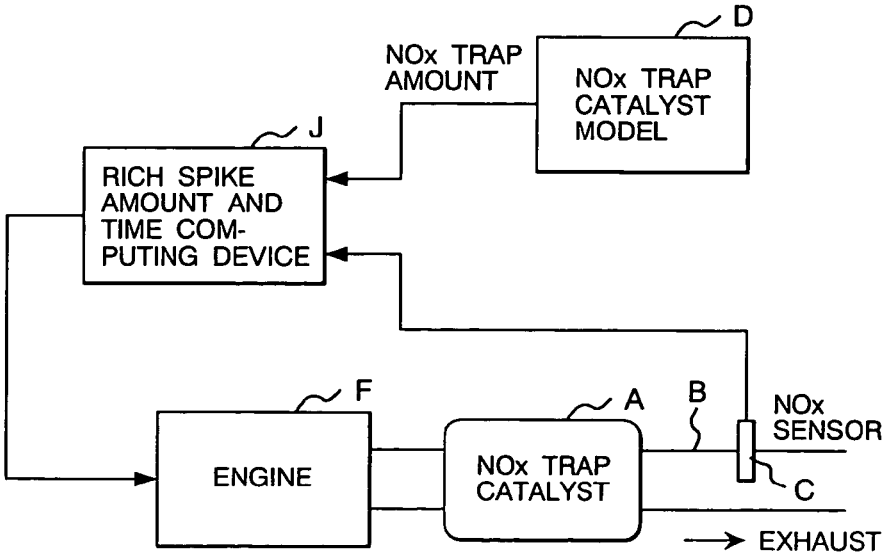
FIG. 5 is a Diagram showing the engine control system according to claim 8.
Figure 6:
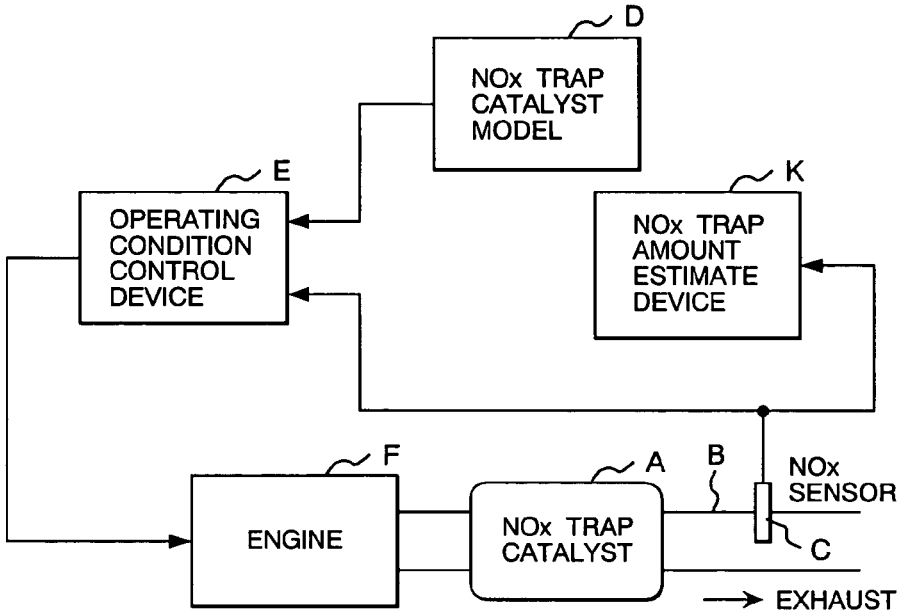
FIG. 6 is a Diagram showing the engine control system according to claim 2.
Figure 7:
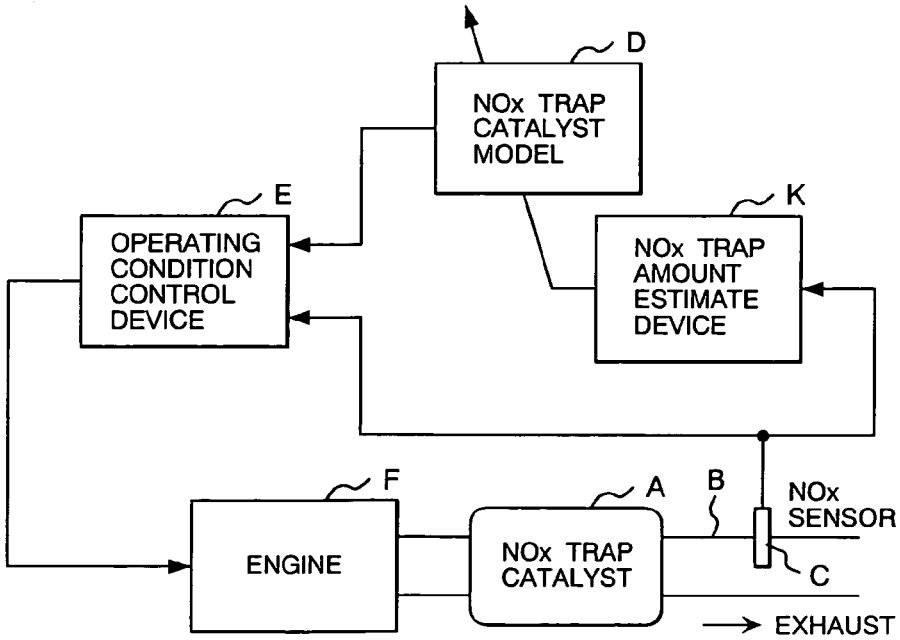
FIG. 7 is a Diagram showing the engine control system according to claim 10.
Figure 8:
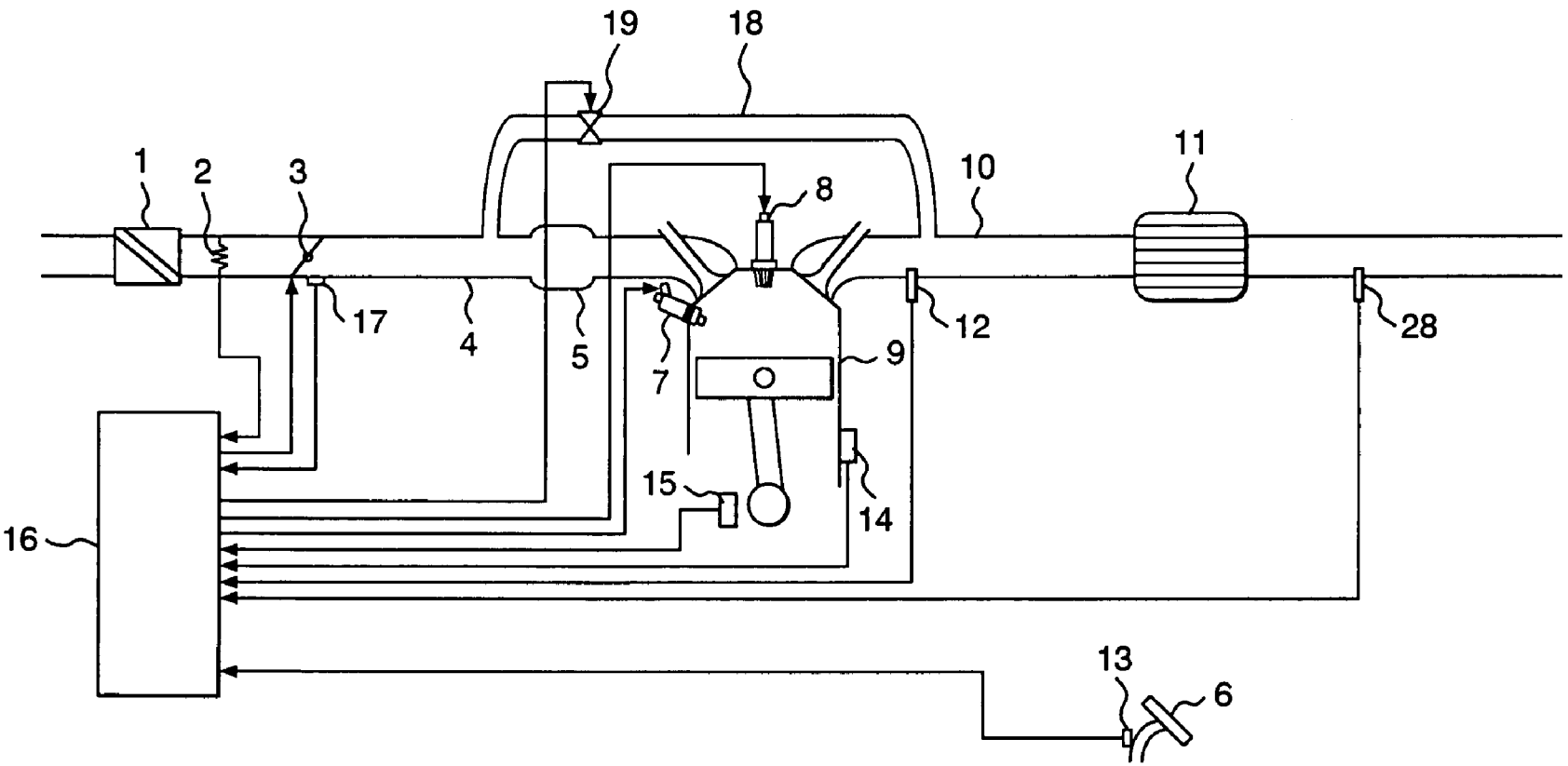
FIG. 8 is a Diagram showing the engine control system in the embodiments 1 to 5.

FIG. 8 is a system diagram showing the embodiment. In FIG. 8, although the direct injection type engine which injects the fuel directly to each cylinder is shown as an example, the engine is not limited by it. In the direct injection type engine comprising multiple cylinders, air taken from the outside passes through an air cleaner 1 and flows through a intake manifold 4 and collector 5, and then into the each cylinder. The intake air flow rate is adjusted by an electronic throttle device 3. An air flow sensor 2 detects the intake air flow rate. A crank angle sensor 15 outputs a signal by every one degree of the crankshaft rotating angle. A water temperature sensor 14 detects the cooling water temperature of the engine. An accelerator opening sensor 13 detects the stepping depth of the accelerator 6 and detects the driver required torque accordingly. Each signal from the accelerator opening sensor 13, air flow sensor 2, opening sensor 17 installed on the electronic throttle 3, crank angle sensor 15 and water temperature sensor 14 is sent to a control unit 16, where the operating condition of the engine is obtained from these sensor outputs. The suitable operating quantities of the engine such as an air flow rate, a fuel injection quantity and ignition timing are computed appropriately based on the sensor outputs. The fuel injection quantity computed in the control unit 16 is converted into the valve open pulse signal of each injector and sent to the fuel injector (injection valve) 7 mounted in the cylinder. Besides, a ignition drive signal is sent to each ignition plug 8 so that the engine is ignited at the ignition timing computed in the control unit 16. The injected fuel is mixed with the air from the intake manifold and flows into the cylinder of the engine 9. The air-fuel mixture in the engine (cylinder) is exploded by a spark generated by the ignition plug 8 at the specified ignition timing, and the combustion pressure presses down the piston to drive the engine. The exhaust after explosion is sent through an exhaust manifold 10 into the NOx trap catalyst 11. Part of the exhaust is returned through an exhaust return pipe 18 to the intake air pipe. The return amount of the exhaust is controlled by a valve 19. An A/F sensor 12 is installed between the engine 9 and NOx trap catalyst 11, and the output has a linear output characteristic for the oxygen density contained in the exhaust. Since the oxygen density in the exhaust relates to the air-fuel ratio almost linearly, the air-fuel ratio can be obtained from the A/F sensor that detects the oxygen density. A NOx trap catalyst 11 traps (captures) the NOx at the lean operation and emits NOx at the rich operation. Since the NOx trap catalyst 11 has a three way catalytic conversion performance, it functions to reduce NOx emitted at the rich operation. A NOx sensor 28 is installed in the downstream side of the NOx trap catalyst 11. In the control unit 16, the air-fuel ratio in the upstream side of the NOx trap catalyst 11 is computed from the signal of A/F sensor 12, and a F/B control for correcting the fuel injection quantity or air flow rate is performed so that the air-fuel ratio of the air-fuel mixture in the engine cylinder equals to the target air-fuel ratio. The signal from the NOx sensor 28 is also sent to the control unit 16, where each operating parameter of the engine is controlled according to the inlet temperature of the NOx trap catalyst.

Figure 9:
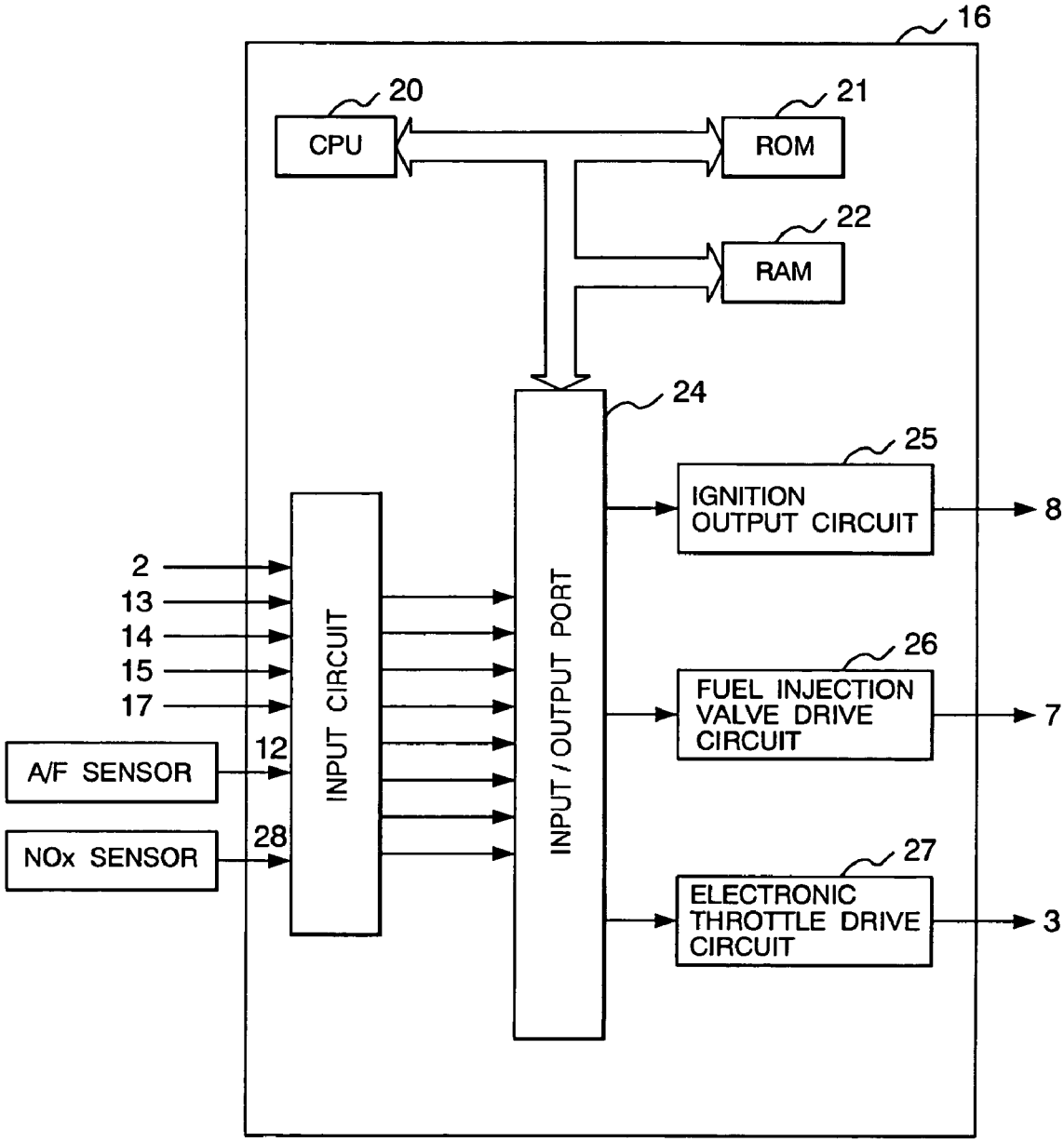
FIG. 9 is a Diagram showing the inside of the control unit in the embodiments 1 to 5.

FIG. 9 shows the inside of the control unit 16. Each sensor output from the A/F sensor, NOx sensor, throttle valve opening sensor, air flow sensor, engine speed sensor and water temperature sensor is inputted into the ECU 16. And after necessary signal processing such as noise elimination is performed in an input circuit 23, each sensor signal is sent to an input/output port 24. Several sensor values at the input port are stored in the RAM and computed in the CPU 20. A control program that describes the computation processing is pre-recorded in the ROM 21. The value representing the operating quantity of each actuator, which is computed in accordance with the control program, is first stored in the RAM 22 and then sent to the output port 24. The actuation signal of the ignition plug used for generating a spark is set ON when the primary coil in the ignition output circuit is energized, and is set OFF when not energized. The ignition timing is equivalent to a timing where the ignition signal changed from ON to OFF. A signal for the ignition plug set at the output port is amplified to a sufficient level of energy necessary for combustion in the ignition output circuit 25 and supplied to the ignition plug. The drive signal of the fuel injection valve is set "ON" when the valve is open and "OFF" when closed. The drive signal for the fuel injection is amplified to a sufficient level of energy necessary for opening the fuel injection valve in the fuel injection valve drive circuit 26, and then sent to the fuel injection valve 7. A drive signal for realizing the target opening of the electronic throttle 3 is sent through the electronic throttle drive circuit 27 to the electronic throttle 3.

Figure 10:
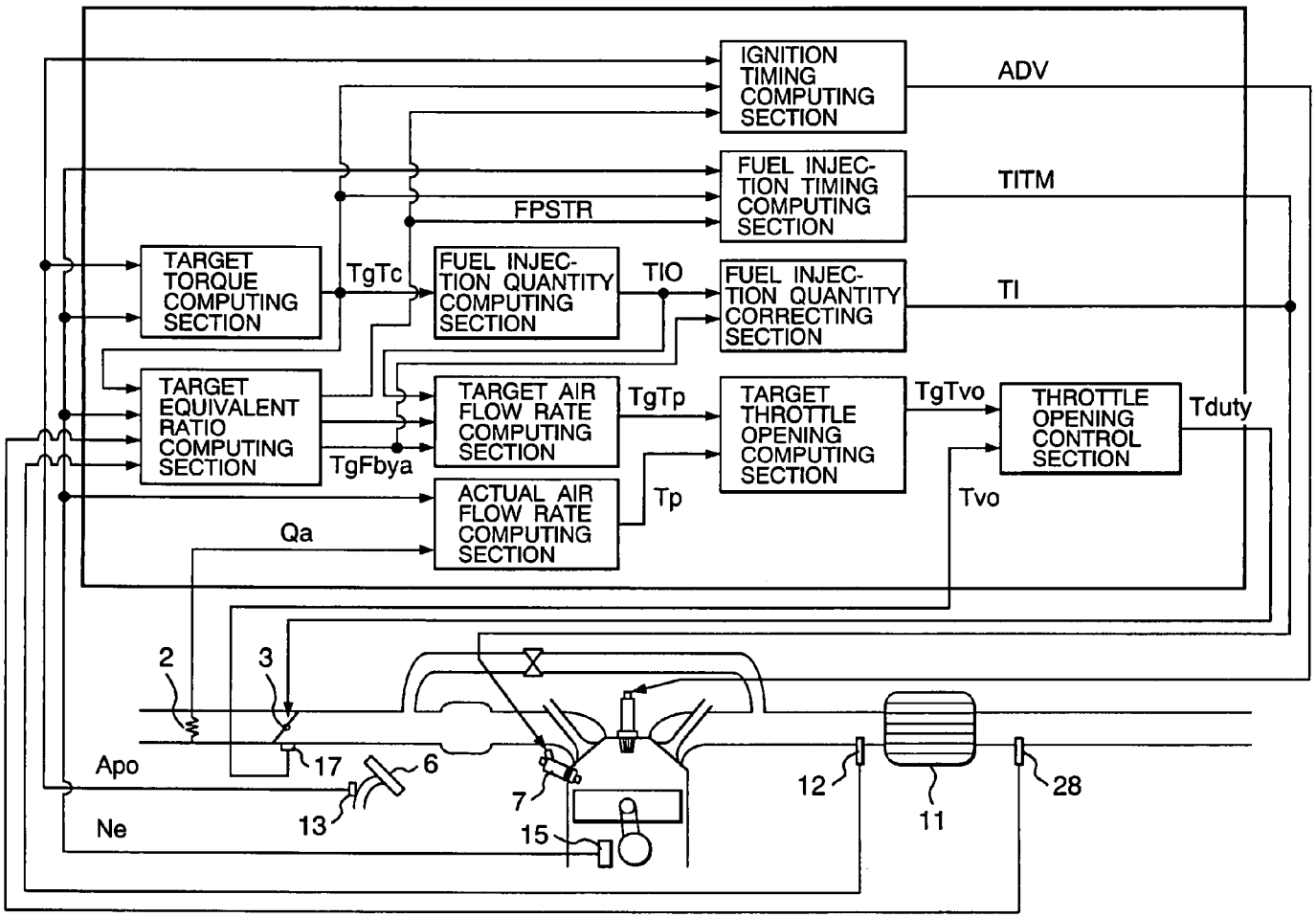
FIG. 10 is a Block diagram showing the total control in the embodiments 1 to 5.

Description below explains the control program stored in the ROM 21. FIG. 10 is a block diagram of the total control, showing the primary part of the fuel precedence type torque demand control. This control comprises a target torque computing section, a fuel injection quantity computing section, a target equivalent ratio computing section, a target air flow rate computing section, an actual air flow rate computing section, a target throttle opening computing section, and a throttle opening controlling section. In the target torque computing section, to start with, the target toque opening TgTc is computed from the accelerator opening Apo and engine speed Ne. Then, the fuel injection quantity TI0 for realizing the target torque is computed. In the fuel injection quantity correcting section, a phase correction is made so that the fuel injection quantity TI0 conforms to the phase in the cylinder air. The corrected fuel injection quantity is called TI. In the target equivalent ratio computing section, the target equivalent ratio TgFbya is computed from the target torque TgTc and engine speed Ne. While representing the air to fuel ratio by an equivalent ratio is solely for the convenience in computation, the air-fuel ratio itself can be used instead. Besides, in the target equivalent ratio computing section, the section also determines any shall be performed between homogeneous combustion and stratified combustion (stratified combustion permission flag: FPSTR). In the target air flow rate computing section, the target air flow rate TgTp is computed from the fuel injection quantity TI0 and target equivalent ratio TgFbya. The target air flow rate TgTp is a value standardized, for the convenience sake, as the air flow rate flowing into a cylinder at every cycle, about which explanation will be given later. In the actual air flow rate computing section, the mass flow rate Qa of the air detected by the airflow sensor is converted into the actual air flow rate Tp flowing into a cylinder at every cycle, and then outputted. In the target throttle opening computing section, the target throttle opening TgTvo is computed based on the target air flow rate TgTp and the actual air flow rate Tp. In the throttle opening computing section, the throttle operating quantity Tduty is computed from the target throttle opening TgTvo and the actual opening Tvo. Tduty represents the duty ratio of the PWM signal inputted into the drive circuit that controls the throttle motor driving current. In the ignition timing computing section, appropriate ignition timing is computed according to each operating condition. In the fuel injection timing computing section, appropriate injection timing is computed according to each operating condition. Detailed description of each control block is given hereunder.

1. Target Torque Computing Section (FIG. 11)

Figure 11:
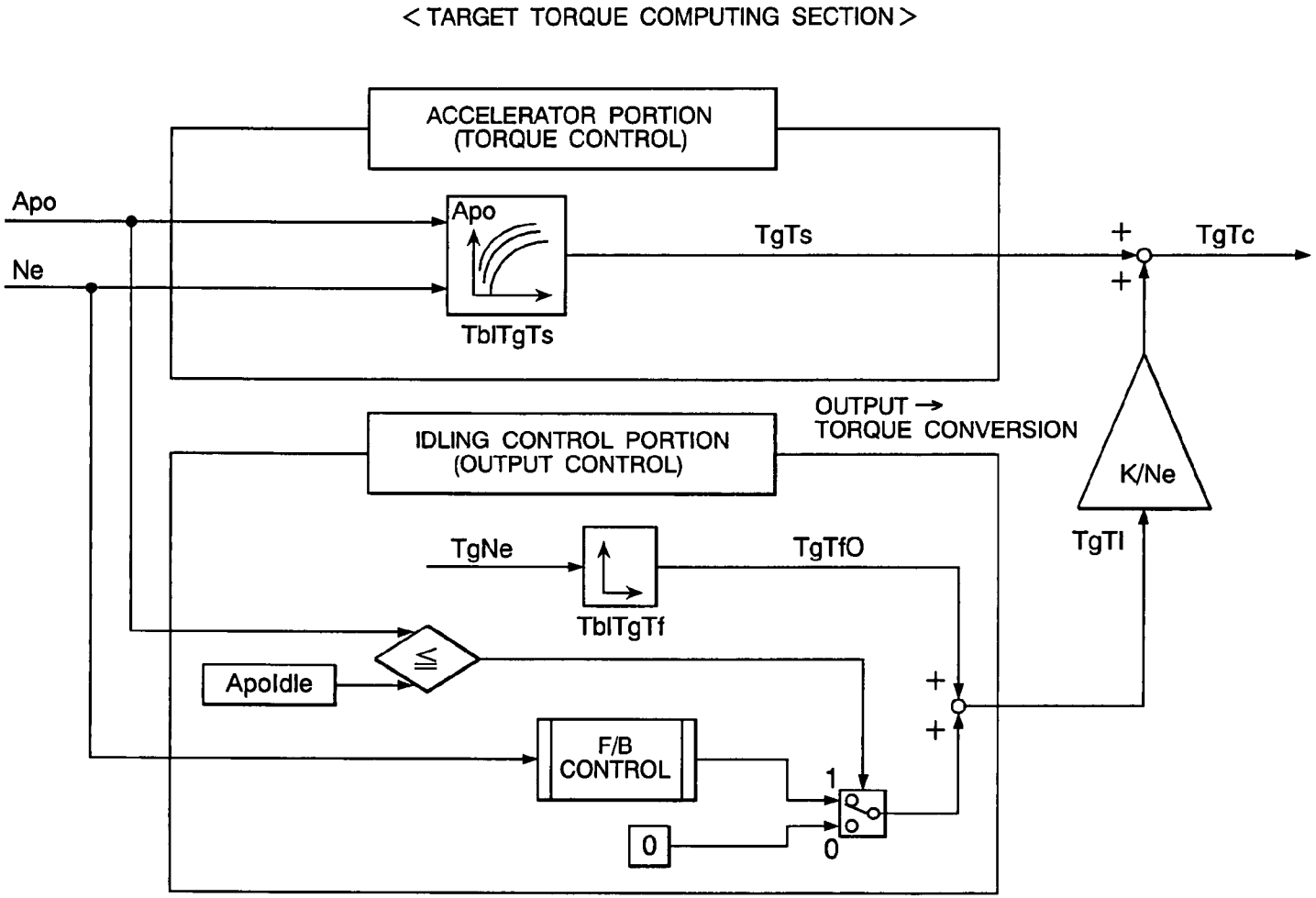
FIG. 11 is a Block diagram showing the target torque computing section in the embodiments 1 to 5.

This block is as shown in FIG. 11. TgTc represents a torque equivalent to a target combustion pressure (it's called "a target combustion equivalent torque"). TgTs is a torque demanded by the operation of an accelerator (it's called "a torque for accelerator demand"), and TgTl is an air flow rate for maintaining an idling speed, and they are proportional to the output. Wherein a portion for the accelerator demand is equivalent to the torque control, and a portion for idling control is equivalent to the output control. The operating quantity TgTl of the idling control shall be the air flow rate in the stoichiometric operation that is proportional to the output. A gain K/Ne is provided for dimensional conversion from output to torque. K shall be determined by the flow characteristic of the injector. A portion TgTf0 for the idling F/F control is determined by referring the target speed TgNe to the table TblTgTf. The idling F/B control functions only in the idling state so as to correct the error in a portion for the F/F. The engine is determined to be in the idling state if the accelerator opening Apo is less than a specified value AplIdle. No specific algorism for the F/B control is mentioned herein but, for example, PID control is applicable. Values in TblTgTf shall preferably be determined according to the data obtained from an actual engine.

Figure 12:
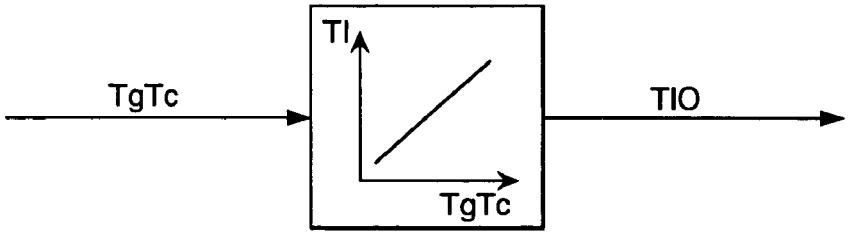
FIG. 12 is a Diagram showing the fuel injection quantity computing section in the embodiments 1 to 5.

2. Fuel Injection Quantity Computing Section (FIG. 12)

In this block, the target combustion pressure torque TgTc is converted into the fuel injection quantity. TI0 is the fuel injection quantity into a cylinder at every cycle, and therefore TI0 is proportional to the torque. With this proportional relationship, TgTc is converted into TI0. Gain can be used for the conversion, but table conversion may be utilized in consideration of some error in gain. Values of the table shall preferably be determined according to the data obtained from an actual engine.

Figure 13:
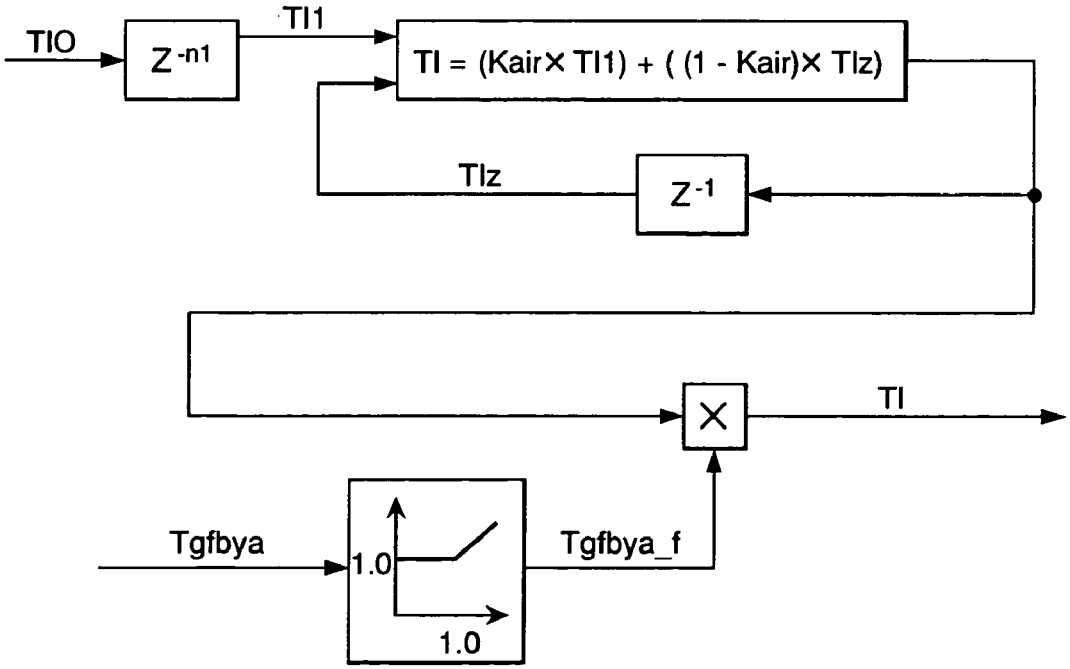
FIG. 13 is a Diagram showing the fuel injection quantity correcting section in the embodiments 1 to 5.

3. Fuel Injection Quantity Correcting Section (FIG. 13)

In this block, the fuel injection quantity TI0 is corrected so as to conform to the phase in the cylinder air. For this, the transfer characteristic of the air from the throttle to the cylinder is approximated using "dead time+first order lag". Each set value of the parameter n1 representing the dead time and parameter Kair equivalent to the time constant of the first order lag shall preferably be determined according to the data obtained from an actual engine. Besides, n1 and Kair may be varied depending upon various operating conditions.

Tgfbya_f represents the target equivalent ratio in the rich spike operation. Tgfbya_f is held at 1.0 when Tgfgya is less than the theoretical air-fuel ratio. The air-fuel ratio control is employed for controlling by the air flow rate on the lean side and fuel quantity on the rich side, about which explanation will be given later.

Figure 14:
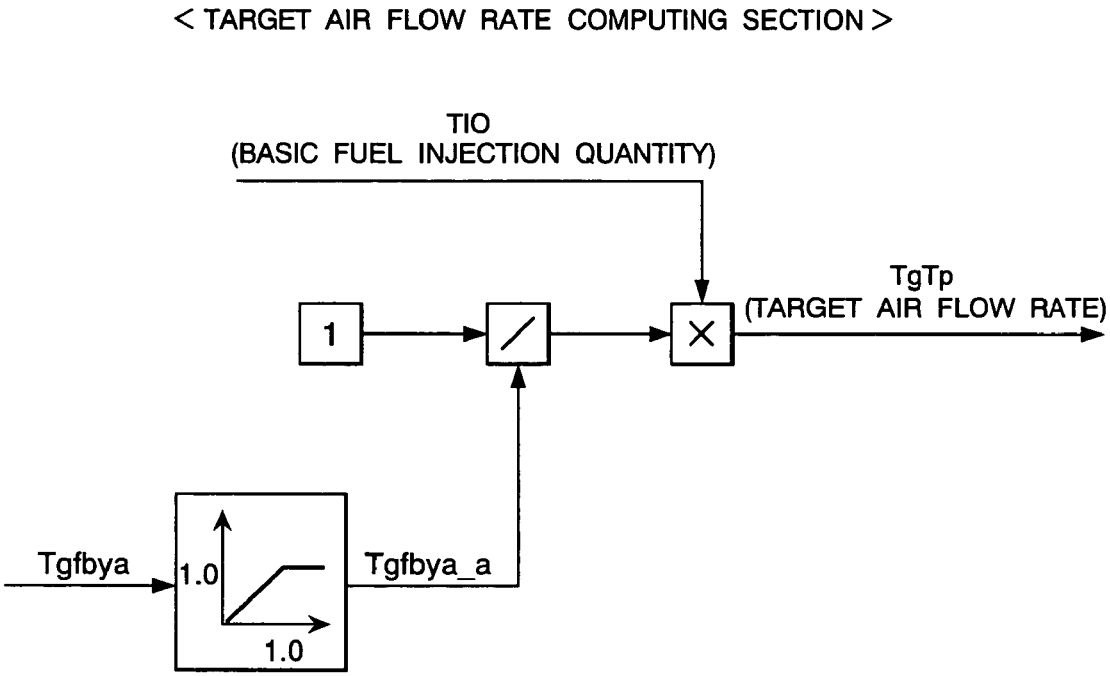
FIG. 14 is a Diagram showing the target air flow rate computing section in the embodiments 1 to 5.

4. Target Air Flow Rate Computing Section (FIG. 14)

Figure 24:
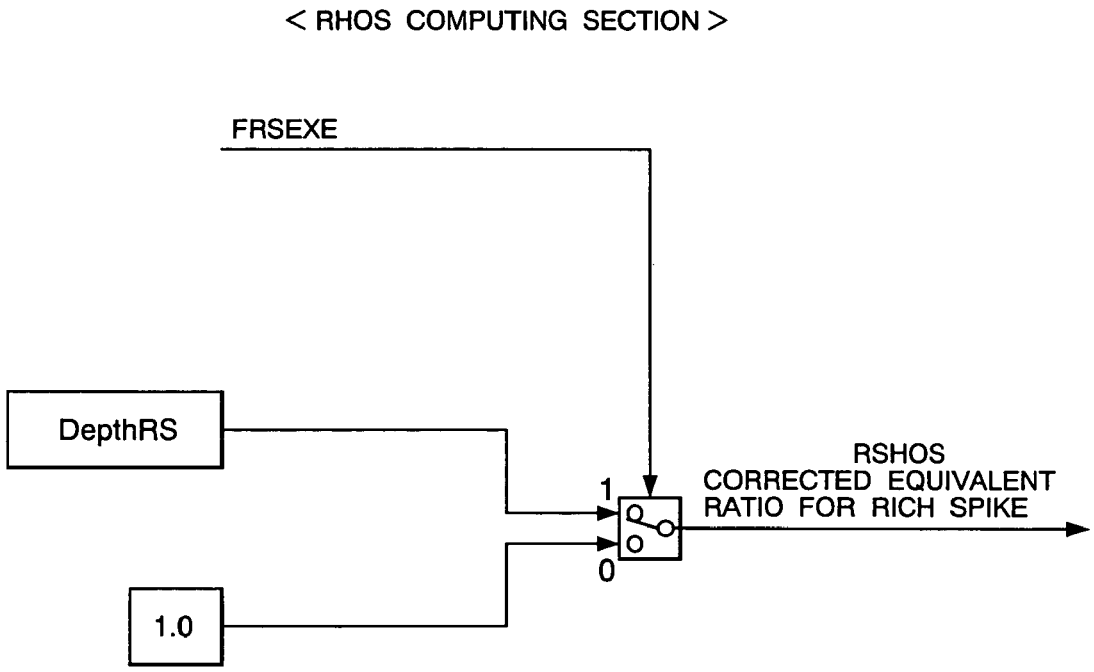
FIG. 24 is a Diagram showing the RHOS computing section in the embodiments 1 and 3 to 5.

In this block, the target air flow rate is computed. For the convenience sake, the target air flow rate used for the computation is a value standardized as the air flow rate flowing into a cylinder at every cycle. As shown in FIG. 24, the target air flow rate TgTp is computed as:

$$TgTp = TI0 \times (1/TgFbya_a)$$

Tgfbya_a is held at 1.0 when Tgfgya is less than the theoretical air-fuel ratio. As explained above, the air-fuel ratio control is controlled by the air flow rate on the lean side and fuel quantity on the rich side.

Figure 15:
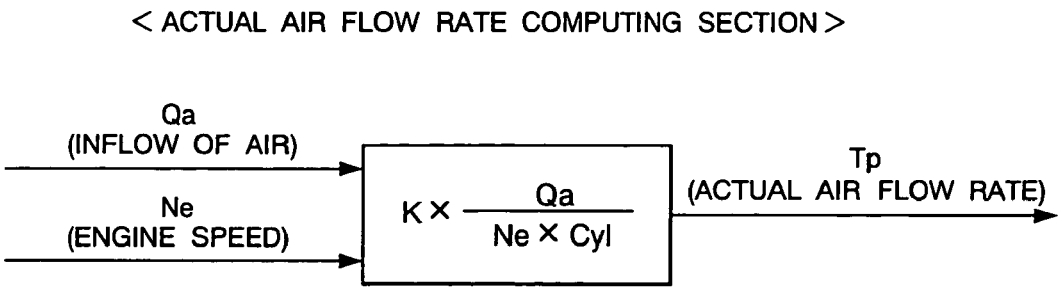
FIG. 15 is a Diagram showing the actual air flow rate computing section in the embodiments 1 to 5.

5. Actual Air Flow Rate Computing Section (FIG. 15)

In this block, the actual air flow rate is computed. For the convenience sake, the actual air flow rate used for the computation is a value standardized as the air flow rate flowing into a cylinder at every cycle. Qa is the air flow rate detected by the airflow sensor 2. Besides, K is so determined that Tp becomes the fuel injection quantity under the theoretical air-fuel ratio. Cyl is the number of cylinders of the engine.

Figure 16:
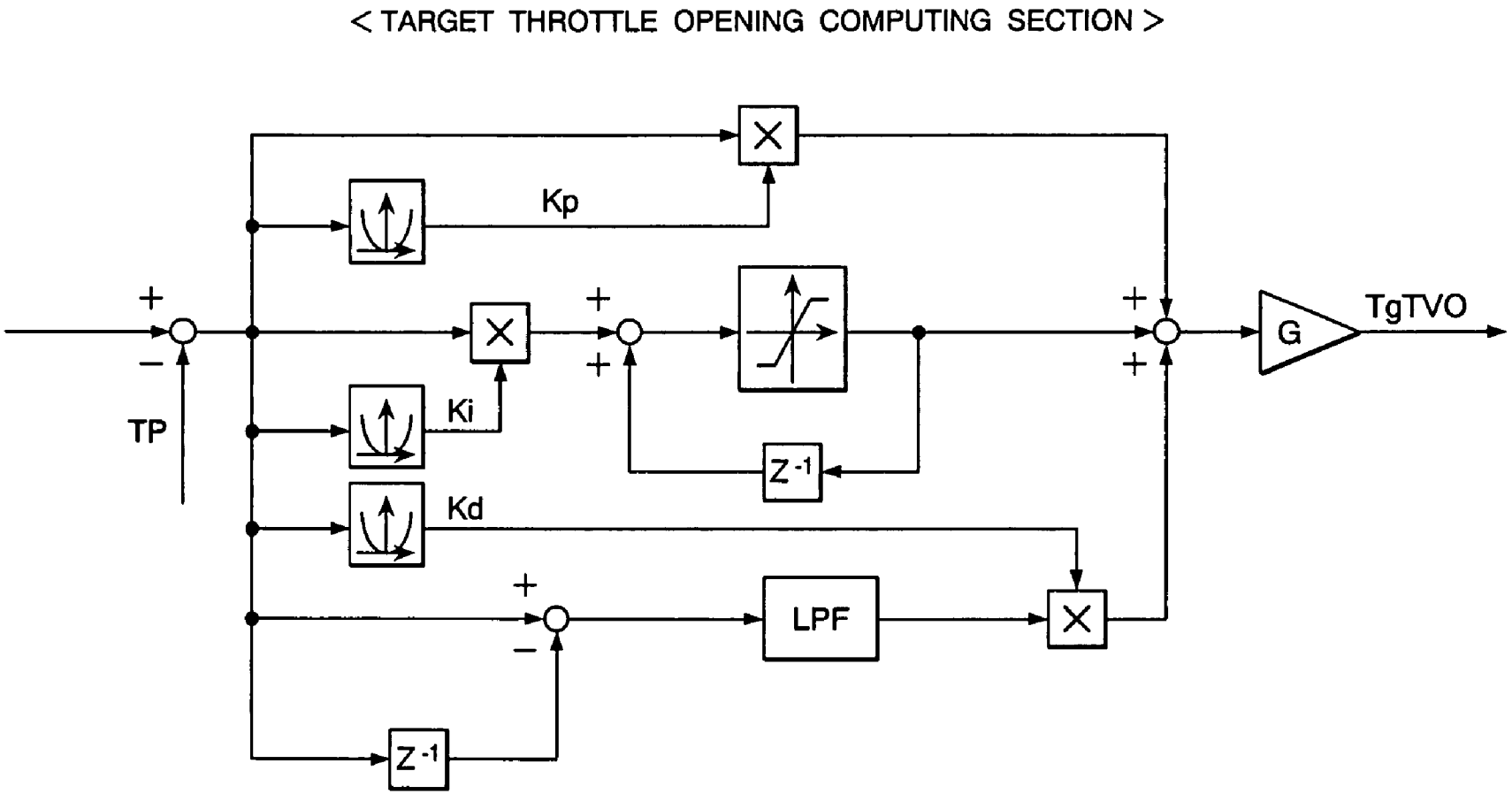
FIG. 16 is a Diagram showing the target throttle opening computing section in the embodiments 1 to 5.

6. Target Throttle Opening Computing Section (FIG. 16)

In this block, the target throttle opening TgTvo is obtained from the target air flow rate TgTp and actual air flow rate Tp. PID (proportion, integral calculus, differential calculus) control is employed for the F/B control. Each gain is given as the size of deviation of TgTp and Tp, but practical values shall preferably be determined according to the data obtained from an actual engine. A LPF (low pass filter) for eliminating high-frequency noise is provided for the D component.

Figure 17:
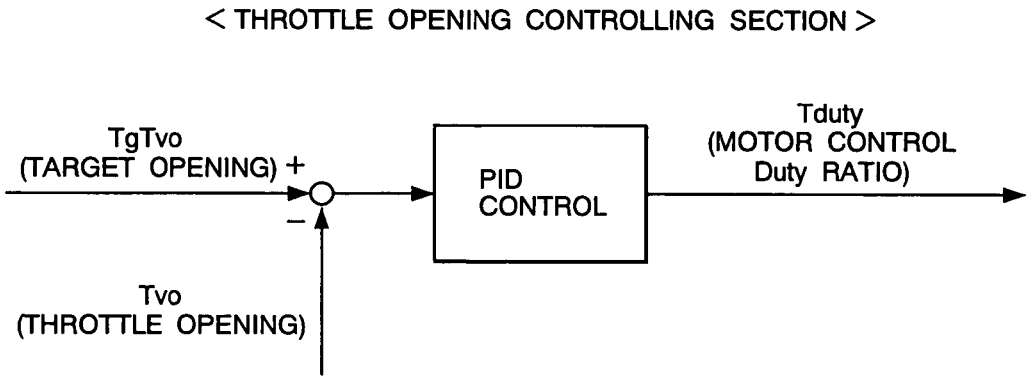
FIG. 17 is a Diagram showing the throttle opening controlling section in the embodiments 1 to 5.

7. Throttle Opening Controlling Section (FIG. 17)

In this block, the operating quantity Tduty for driving the throttle is computed from the target throttle opening TgTvo and the actual throttle opening Tvo. As explained before, Tduty represents the duty ratio of the PWM signal inputted into the drive circuit that controls the throttle motor driving current. Tduty is obtained by PID control. Each gain of the PID control shall preferably be tuned to an optimum value on an actual engine, although no particulars are specified herein.

Figure 18:
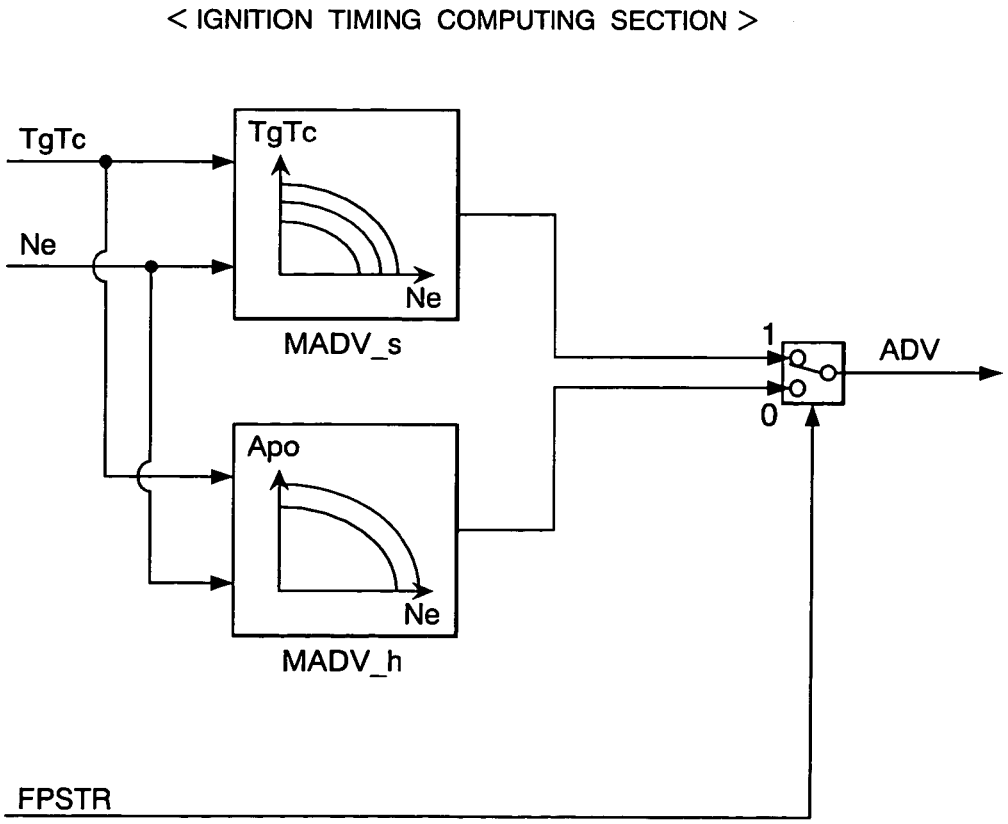
FIG. 18 is a Diagram showing the ignition timing computing section in the embodiments 1 to 5.

8. Ignition Timing Computing Section (FIG. 18)

In this block, the ignition timing is computed. As shown in FIG. 18, when FPSTR=1 applies, that is to say, when the stratified combustion is permitted, the ignition timing ADV is obtained by referring TgTc and Ne to the ignition timing MADV_s. When FPSTR=0, that is, when the stratified combustion is not permitted, it is obtained by referring TgTc and Ne to the ignition timing MADV_h.

Values of MADV_h shall be determined in accordance with the engine performance so as to become so-called MBT. Values of MADV_s shall preferably be so determined as to become optimum, along with the value of the ignition timing described below, in consideration of the combustion stability.

Figure 19:
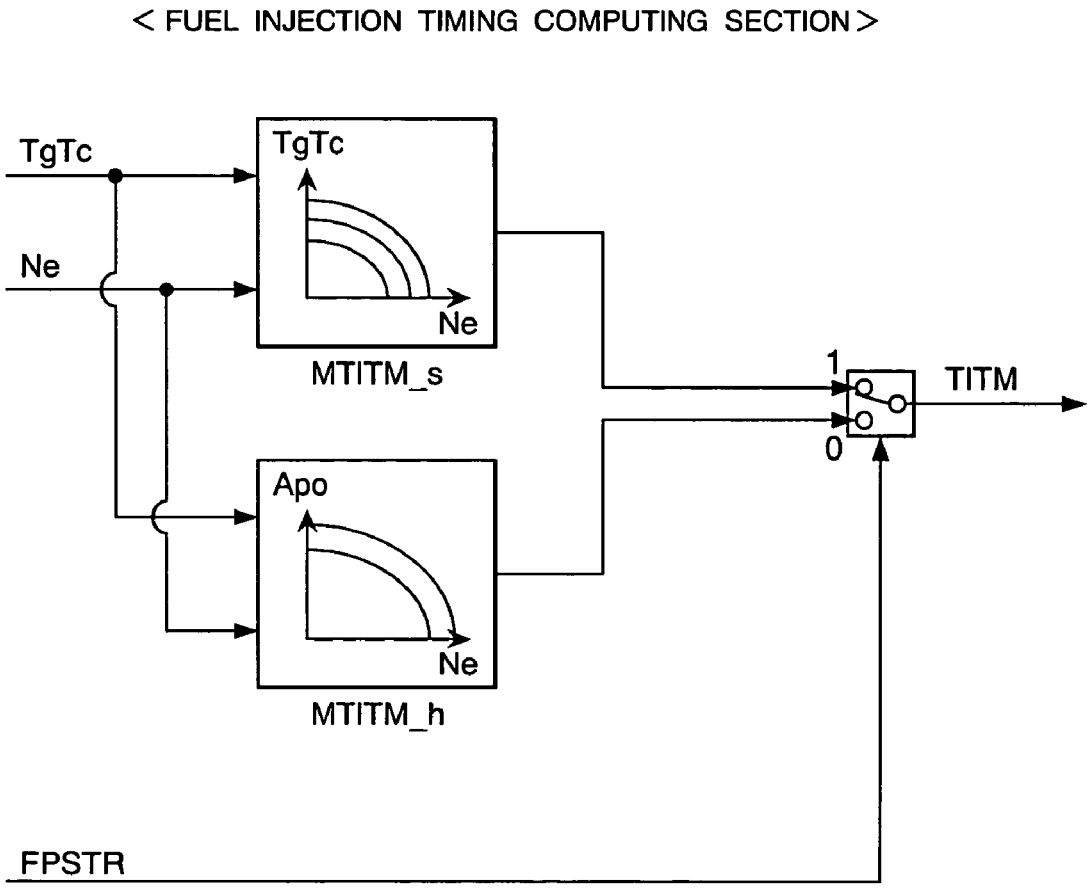
FIG. 19 is a Diagram showing the injection timing computing section in the embodiments 1 to 5.

9. Fuel Injection Timing Computing Section (FIG. 19)

In this block, the injection timing is computed. As shown in FIG. 18, when FPSTR=1 applies, that is to say, when the stratified combustion is permitted, the injection timing TITM is obtained by referring TgTc and Ne to the ignition timing MTITM_s. When FPSTR=0, that is, when the stratified combustion is not permitted, it is obtained by referring TgTc and Ne to the ignition timing MTITM_h. Values of each MTITM_s and MADV_s shall preferably be so determined as to become optimum, along with the value of the ignition timing described above, in consideration of the combustion stability.

Figure 20:
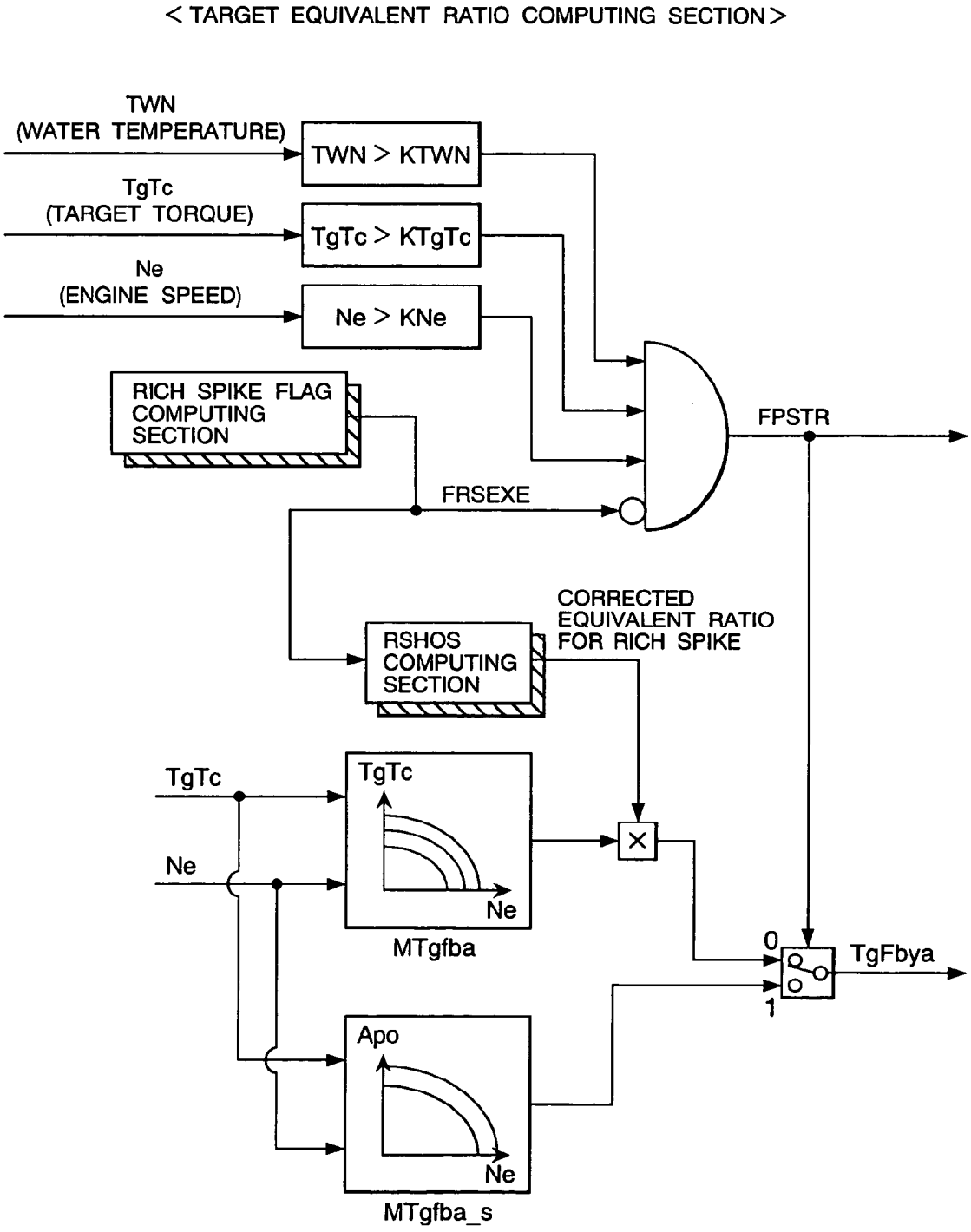
FIG. 20 is a Diagram showing the target equivalent weight ratio computing section in the embodiments 1 and 3 to 5.

10. Target Equivalent Ratio Computing Section (FIG. 20)

In this block, the ignition condition is determined, and the target equivalent ratio is computed. FPSTR is a permission flag of the stratified combustion and, when FPSTR=1 applies, the injection timing, the ignition timing, the injection quantity and the air flow rate are controlled so that the stratified combustion is performed. The stratified combustion permission flag FPSTR=1 applies when TWN>KTWN and TgTc>KTgTc and Ne<KNe and FRSEXE=0 are all met. Otherwise, FPSTR=0 applies. In this description:

KTWN: Water temperature for permitting stratified combustion

KTgTc: Torque for permitting Stratified combustion

KNe: Engine speed for permitting stratified combustion

Each set value shall preferably be determined in accordance with the engine performance. When the stratified combustion is permitted, that is, FPSTR=1 applies, a value obtained by referring the target combustion pressure torque TgTc and engine speed Ne in the equivalent ratio map Mtgfba_s for stratified combustion shall be the target equivalent ratio TgFbya. The operation shall be homogeneous combustion when FPSTR=0 applies, and a value obtained by referring the target combustion pressure torque TgTc and engine speed Ne in the equivalent ratio map Mtgfba for homogeneous combustion shall be the target equivalent ratio TgFbya. Values of each equivalent ratio map Mtgfba_s for stratified combustion and equivalent weight ratio map Mtgfba for homogeneous combustion shall preferably be determined according to the data obtained from an actual engine.

The rich spike flag FRSEXE is set to 1 during the rich spike operation and set to 0 otherwise. The time and amount of rich spike is obtained by correcting the target equivalent ratio for homogeneous combustion by RSHOS.

Figure 21:
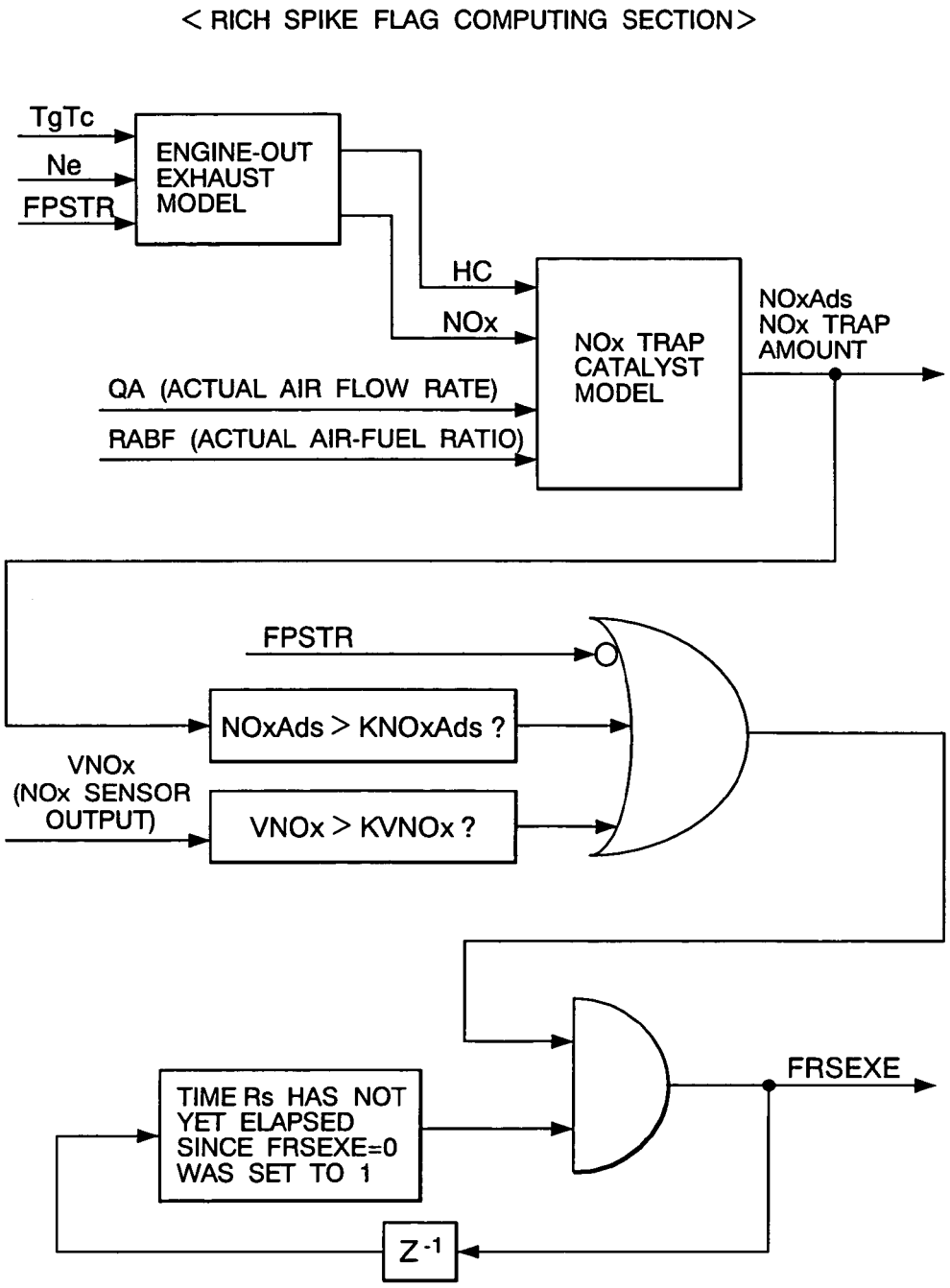
FIG. 21 is a Diagram showing the rich spike flag computing section in the embodiments 1 and 2.

11. Rich Spike Flag Computing Section (FIG. 21)

In this block, the rich spike flag FRSEXE is computed. FRSEXE=1 applies when any of FPSTR=0 or NOxAds>KNOxADS or VNOx>KVNOx is met. However, after TimeRs has elapsed since FRSEXE=0 was changed to FRSEXE=1, FRSEXE=0 applies.

In this description:

NOxADS: NOx trap amount estimated by the model (NOx trap catalyst model)

KNOXADS: Threshold of NOxADS for demanding Rich spike

VNOX: Output of the NOx sensor

KVNOx: Threshold of VNOx for demanding Rich spike

In other words, when the NOx trap amount estimated by the model exceeds a specified value, or when the output of the NOx sensor exceeds a specified value, the NOx trap amount in the NOx catalyst is judged to be saturated and the rich spike operation is started.

Besides, as shown in the figure, the rich spike time shall be given as TimeRS.

KNOxADS and KVNOX shall preferably be determined according to the target exhaust performance in consideration of the catalyst performance and engine performance.

Figure 22:
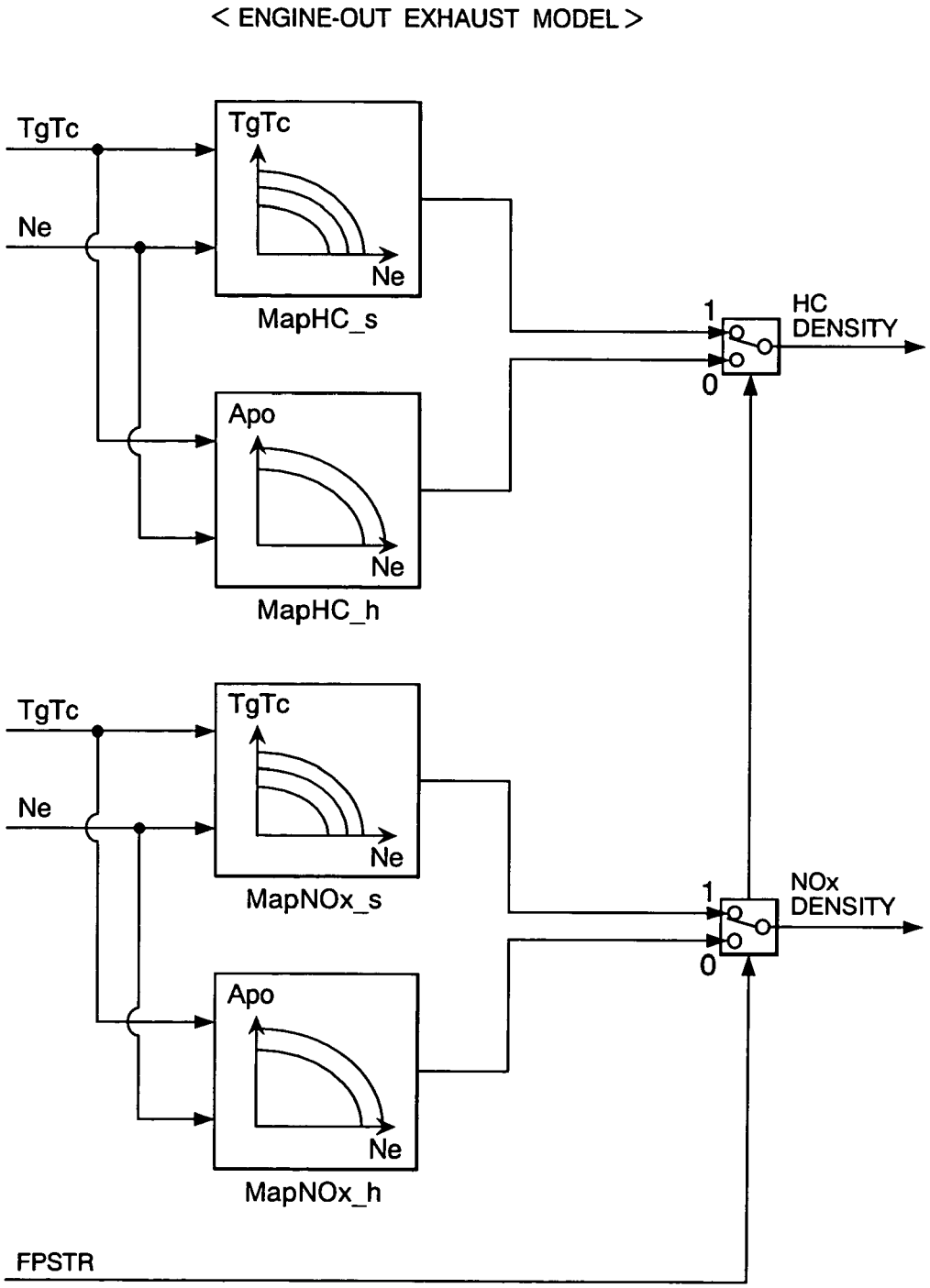
FIG. 22 is a Diagram showing the engine-out exhaust model in the embodiments 1 to 5.

12. Engine-out Exhaust Model (FIG. 22) FIG. 22 shows an engine-out exhaust model. As shown in FIG. 22, when FPSTR=1 applies, that is, when the stratified combustion is permitted, the HC density and the NOx density under the engine-out condition are obtained by referring TgTc and Ne to MapHC_s and MapNOx_s. When FPSTR=0 applies, that is, when the stratified combustion is not permitted, they are obtained by referring MapHC_h and MapNOx_h by using. Values of each map shall preferably be determined from the engine performance.

Figure 23:
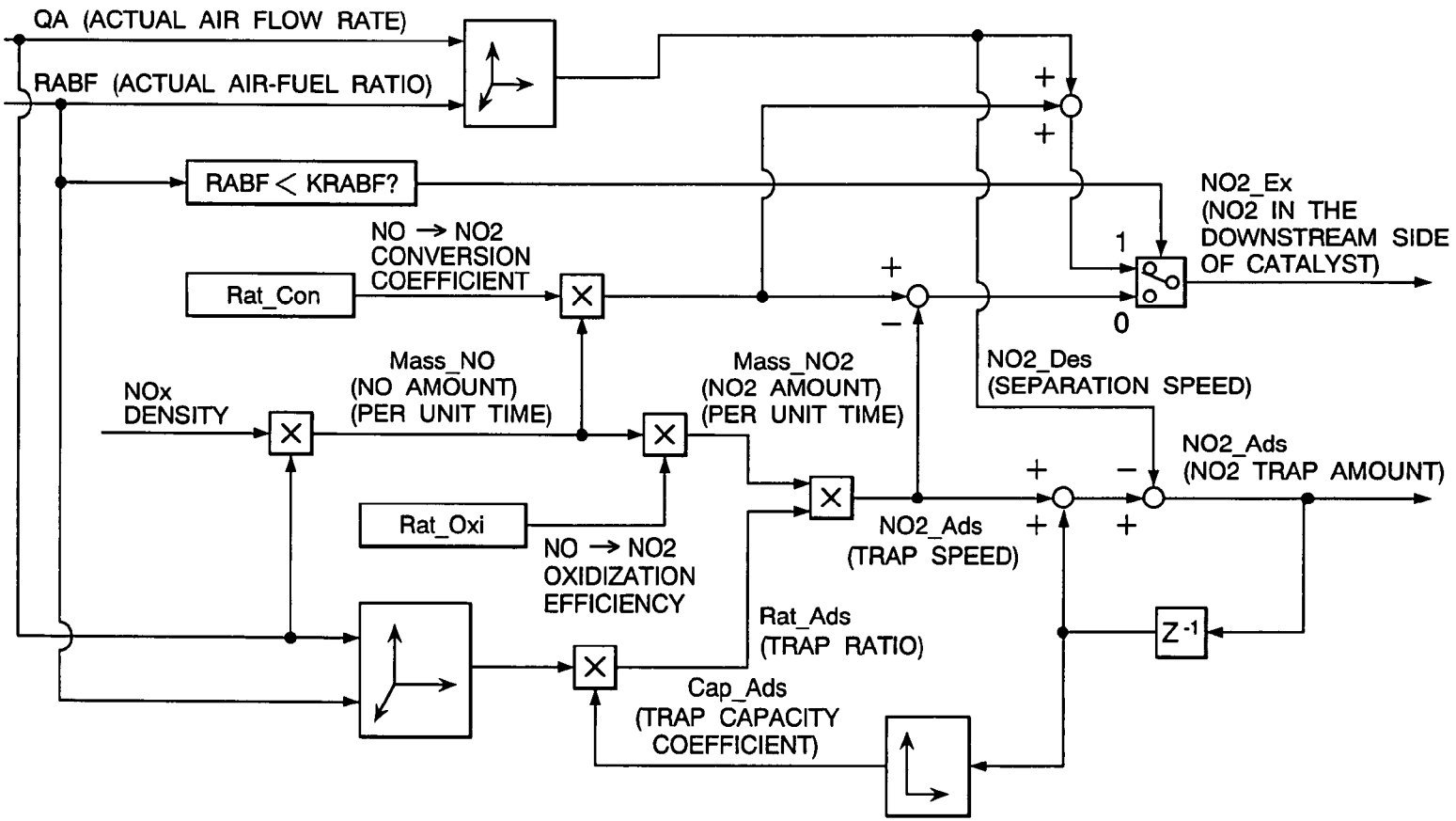
FIG. 23 is a Diagram showing the NOx trap catalyst model in the embodiments 1 to 3.

13. NOx Trap Catalyst Model (FIG. 23) FIG. 23 shows the NOx trap catalyst model.

Whether the catalyst is in a trap state of the NOx or escape (separation) state is judged from the actual air-fuel ratio RABF. To be concrete, when RABF<KRABF is met, the catalyst is judged to be in the reduction atmosphere and in a separation state. The separation (escape) speed NO2_Des is obtained by referring the map by using the actual air flow rate QA and RABF. The separation NOx added by the engine-out NOx is regarded as the NO2 in the downstream side of the catalyst in the reduction atmosphere. Besides, processing in the oxidation atmosphere, that is, in the trap state is as described below.

That is, (1) The engine-out NOx is multiplied by the air flow rate QA per unit time to convert into Mass_NO which is the NO amount per unit time.

(2) Mass_NO is multiplied by Rat_Oxi (oxidation efficiency from NO to NO2) to convert into Mass_NO2 which is the NO2 amount per unit time.

(3) Mass_NO2 is multiplied by the trap ratio Rat_Ads to compute the trap speed NO2_Ads. Rat_Ads shall be given as the multiplication of the value obtained by referring the trap capacity coefficient Cap_Ads, QA and RABF to the map.

(4) The NO2 trap amount in a time t is obtained by integrating the trap speed NO2_Ads and subtracting the separation speed NO2_Des. Besides, it is so designed that the trap amount coefficient Cap_Ads is obtained by referring the map by using the NO2 absorption amount in a time t.

Although the description above has referred only to the NOx trap and separation performance, actual catalyst also has a three-way catalytic conversion performance, and so its performance may be added to the model. No further description is given herein since some three-way catalytic conversion capability models have already been proposed. Besides, each parameter of this model shall preferably be determined in accordance with the characteristic of the catalyst.

14. RHOS Computing Section (FIG. 24)

FIG. 24 shows the RHOS computing section. When the rich spike flag FRSEXE=1 applies, RSHOS=DepthRS is set and the target equivalent ratio is corrected towards the rich side. Otherwise, RHOS=1.0 is set. DepthRS shall preferably be determined in accordance with the performance of the catalyst.

(Embodiment 2)

In this embodiment, an engine control system according to claim 5 is described hereunder.

FIG. 8 is an engine control system diagram, which is the same system diagram as in the embodiment 1, and so no additional explanation is made. FIG. 9 shows the inside of the control unit 16, which is the same as in the embodiment 1, and so no additional explanation is made. FIG. 10 is a block diagram of the total control, which is the same as in the embodiment 1, and so no additional explanation is made. Detailed description on each control block is given hereunder.

1. Target Torque Computing Section (FIG. 11)

As shown in FIG. 11. It is the same as in the embodiment 1, and so no additional explanation is given.

2. Fuel Injection Quantity Computing Section (FIG. 12)

As shown in FIG. 12. It is the same as in the embodiment 1, and so no additional explanation is given.

3. Fuel Injection Quantity Correcting Section (FIG. 13)

As shown in FIG. 13. It is the same as in the embodiment 1, and so no additional explanation is given.

4. Target Air Flow Rate Computing Section (FIG. 14)

As shown in FIG. 14. It is the same as in the embodiment 1, and so no additional explanation is given.

5. Actual Air Flow Rate Computing Section (FIG. 15)

As shown in FIG. 15. It is the same as in the embodiment 1, and so no additional explanation is given.

6. Target Throttle Opening Computing Section (FIG. 16)

As shown in FIG. 16. It is the same as in the embodiment 1, and so no additional explanation is given.

7. Throttle Opening Controlling Section (FIG. 17)

As shown in FIG. 17. It is the same as in the embodiment 1, and so no additional explanation is given.

8. Ignition Timing Computing Section (FIG. 18)

As shown in FIG. 18. It is the same as in the embodiment 1, and so no additional explanation is given.

9. Fuel Injection Timing Computing Section (FIG. 19)

As shown in FIG. 19. It is the same as in the embodiment 1, and so no additional explanation is given.

10. Target Equivalent Ratio Computing Section (FIG. 25)

Figure 25:
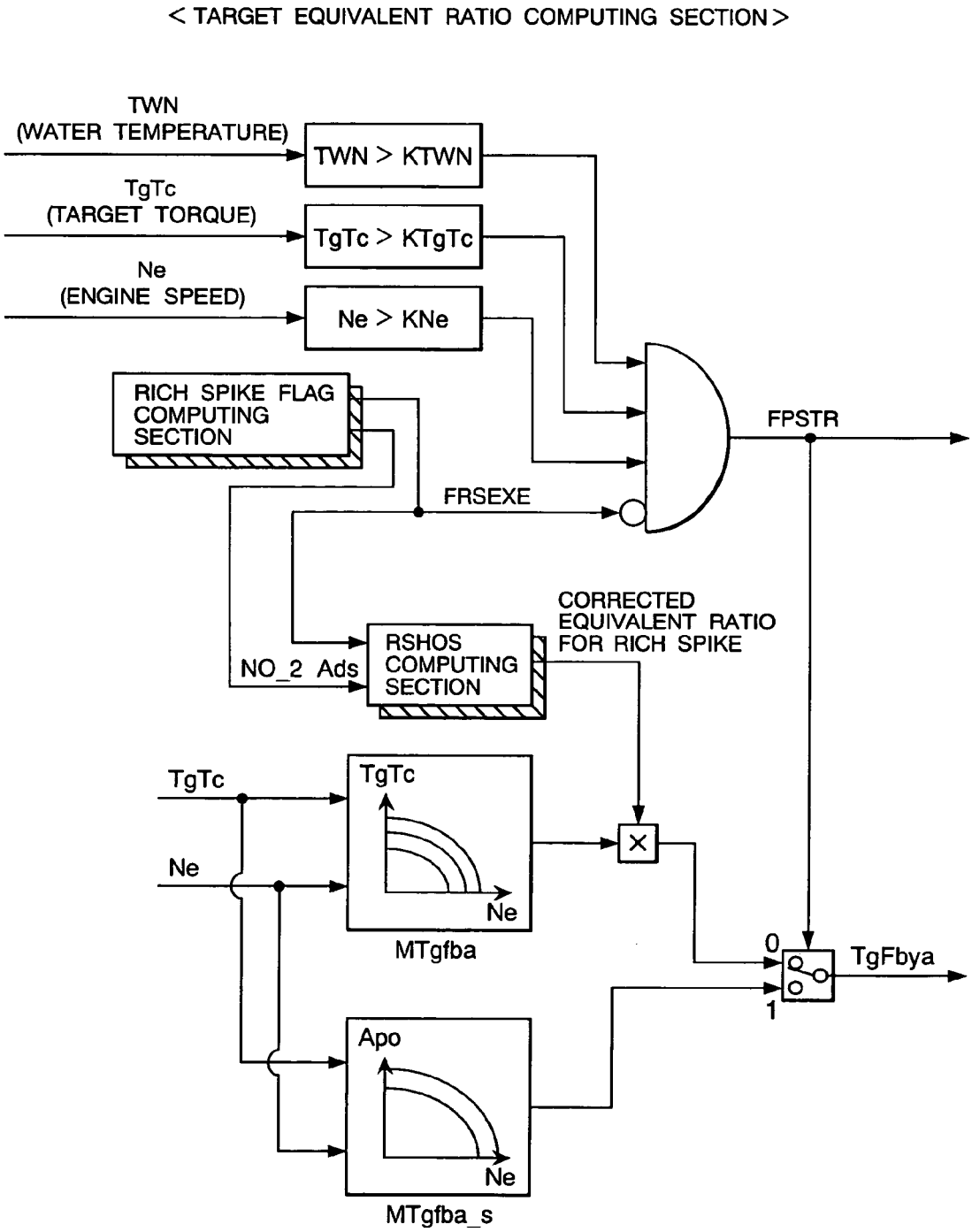
FIG. 25 is a Diagram showing the target equivalent weight ratio computing section in the embodiment 2.

As shown in FIG. 25. It differs from the target equivalent ratio computing section in the embodiment 1 in a point that NO2_Ads outputted from the rich spike flag computing section is inputted into the RSHOS computing section.

11. Rich Spike Flag Computing Section (FIG. 21)

As shown in FIG. 21. It is the same as in the embodiment 1, and so no additional explanation is given.

12. Engine-out Exhaust Model (FIG. 22)

As shown in FIG. 22. It is the same as in the embodiment 1, and so no additional explanation is given.

13. Nox Trap Catalyst Model (FIG. 23)

As shown in FIG. 23. It is the same as in the embodiment 1, and so no additional explanation is given.

14. RHOS computing section (FIG. 26)

Figure 26:
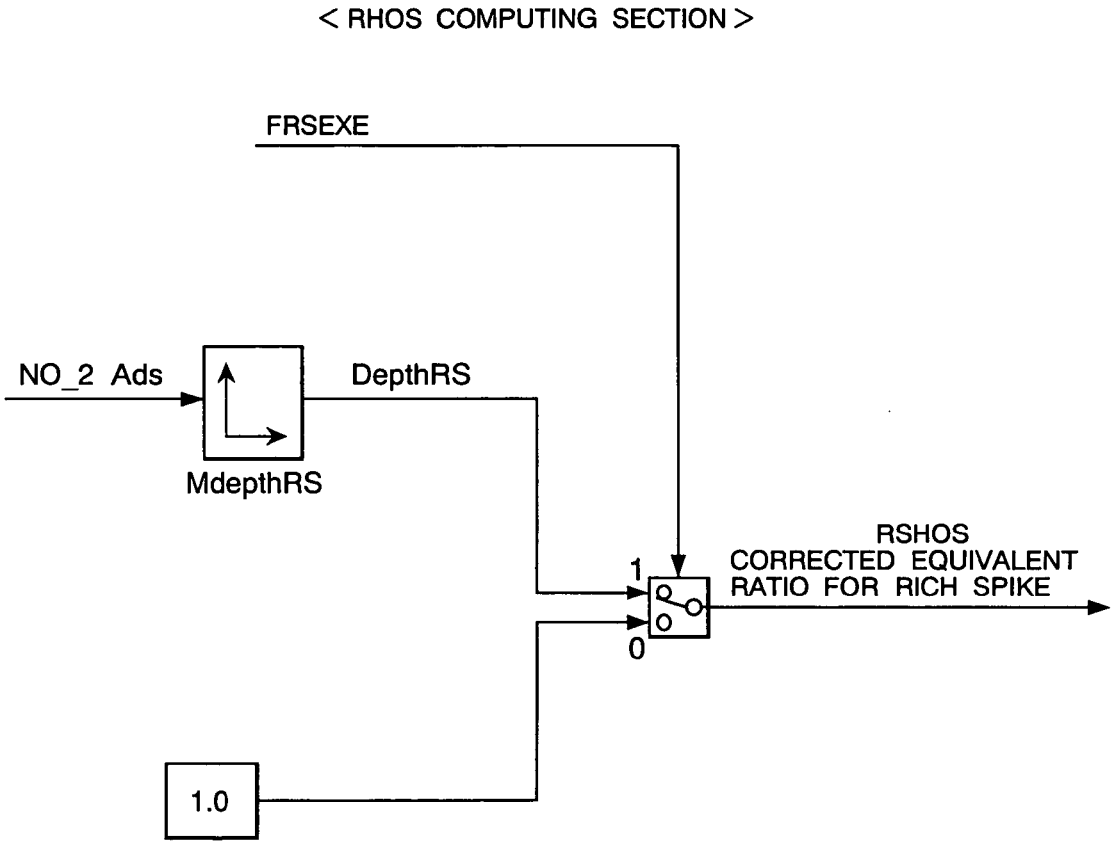
FIG. 26 is a Diagram showing the RHOS computing section in the embodiment 2.

As shown in FIG. 26. It differs from the RHOS computing section in the embodiment 1 in a point that Depth_RS is obtained by referring NO2_Ads to the map MdepthRS. In short, the rich spike amount DepthRS is determined in accordance with the NO2 trap amount NO2_Ads computed by the model. Concrete value shall preferably be determined in accordance with the performance of the catalyst.

(Embodiment 3)

In this embodiment, an engine control system according to claim 6 is described hereunder.

FIG. 8 is an engine control system diagram, which is the same system diagram as in the embodiment 1, and so no additional explanation is made. FIG. 9 shows the inside of the control unit 16, which is the same as in the embodiment 1, and so no additional explanation is made. FIG. 10 is a block diagram of the total control, which is the same as in the embodiment 1, and so no additional explanation is made. Detailed description on each control block is given hereunder.

1. Target Torque Computing Section (FIG. 11)

As shown in FIG. 11. It is the same as in the embodiment 1, and so no additional explanation is given.

2. Fuel Injection Quantity Computing Section (FIG. 12)

As shown in FIG. 12. It is the same as in the embodiment 1, and so no additional explanation is given.

3. Fuel Injection Quantity Correcting Section (FIG. 13)

As shown in FIG. 13. It is the same as in the embodiment 1, and so no additional explanation is given.

4. Target Air Flow Rate Computing Section (FIG. 14)

As shown in FIG. 14. It is the same as in the embodiment 1, and so no additional explanation is given.

5. Actual Air Flow Rate Computing Section (FIG. 15)

As shown in FIG. 15. It is the same as in the embodiment 1, and so no additional explanation is given.

6. Target Throttle Opening Computing Section (FIG. 16)

As shown in FIG. 16. It is the same as in the embodiment 1, and so no additional explanation is given.

7. Throttle Opening Controlling Section (FIG. 17)

As shown in FIG. 17. It is the same as in the embodiment 1, and so no additional explanation is given.

8. Ignition Timing Computing Section (FIG. 18)

As shown in FIG. 18. It is the same as in the embodiment 1, and so no additional explanation is given.

9. Fuel Injection Timing Computing Section (FIG. 19)

As shown in FIG. 19. It is the same as in the embodiment 1, and so no additional explanation is given.

10. Target Equivalent Ratio Computing Section (FIG. 20)

As shown in FIG. 20. It is the same as in the embodiment 1, and so no additional explanation is given.

11. Rich Spike Flag Computing Section (FIG. 27)

Figure 27:
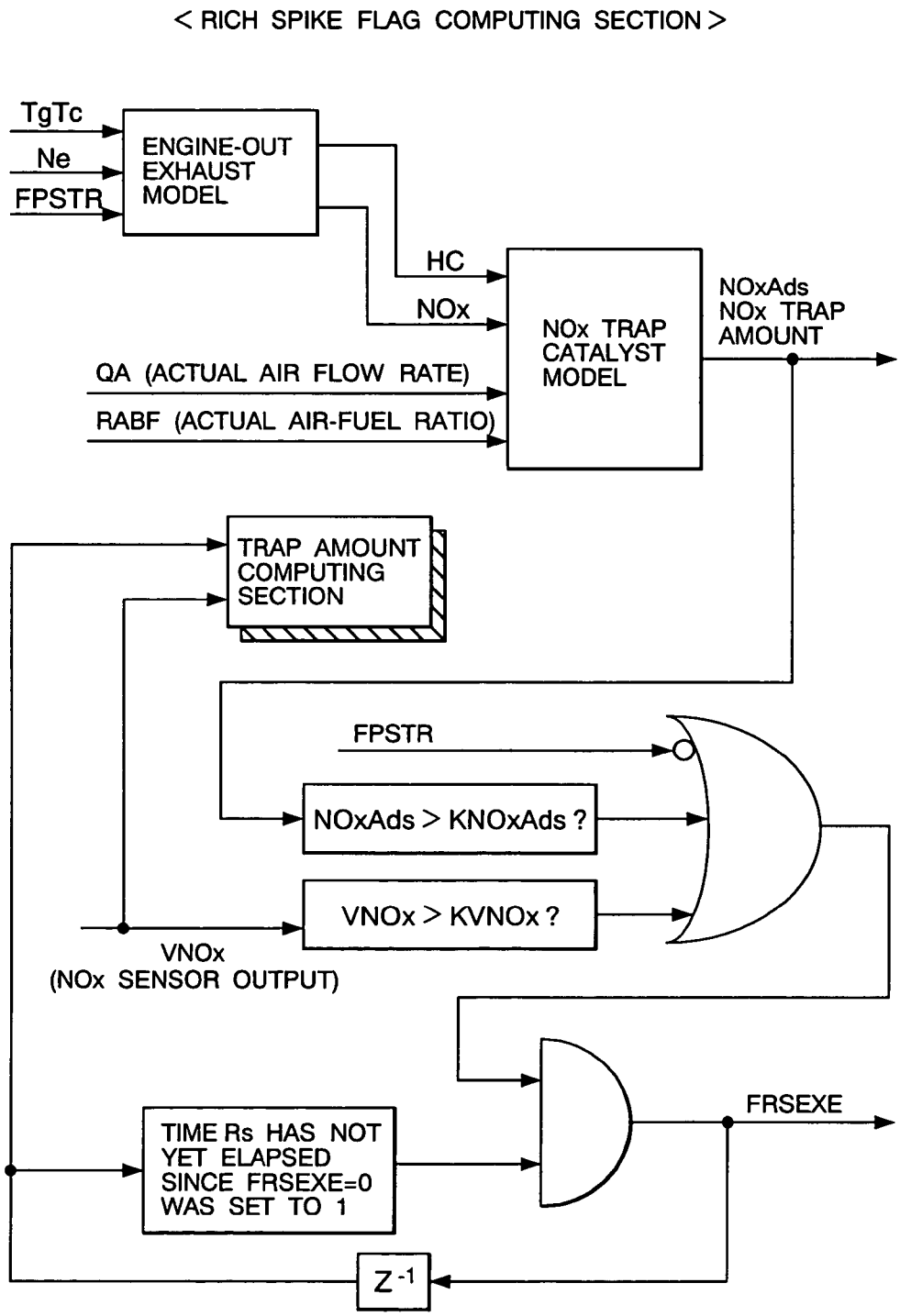
FIG. 27 is a Diagram showing the rich spike flag computing section in the embodiment 3.

As shown in FIG. 27. It differs from the rich spike flag computing section in the embodiment 1 in a point that the trap amount computing section is added.

12. Engine-out Exhaust Model (FIG. 22)

As shown in FIG. 22. It is the same as in the embodiment 1, and so no additional explanation is given.

13. NOx Trap Catalyst Model (FIG. 23)

As shown in FIG. 23. It is the same as in the embodiment 1, and so no additional explanation is given.

14. RHOS Computing Section (FIG. 24)

As shown in FIG. 24. It is the same as in the embodiment 1, and so no additional explanation is given.

Figure 28:
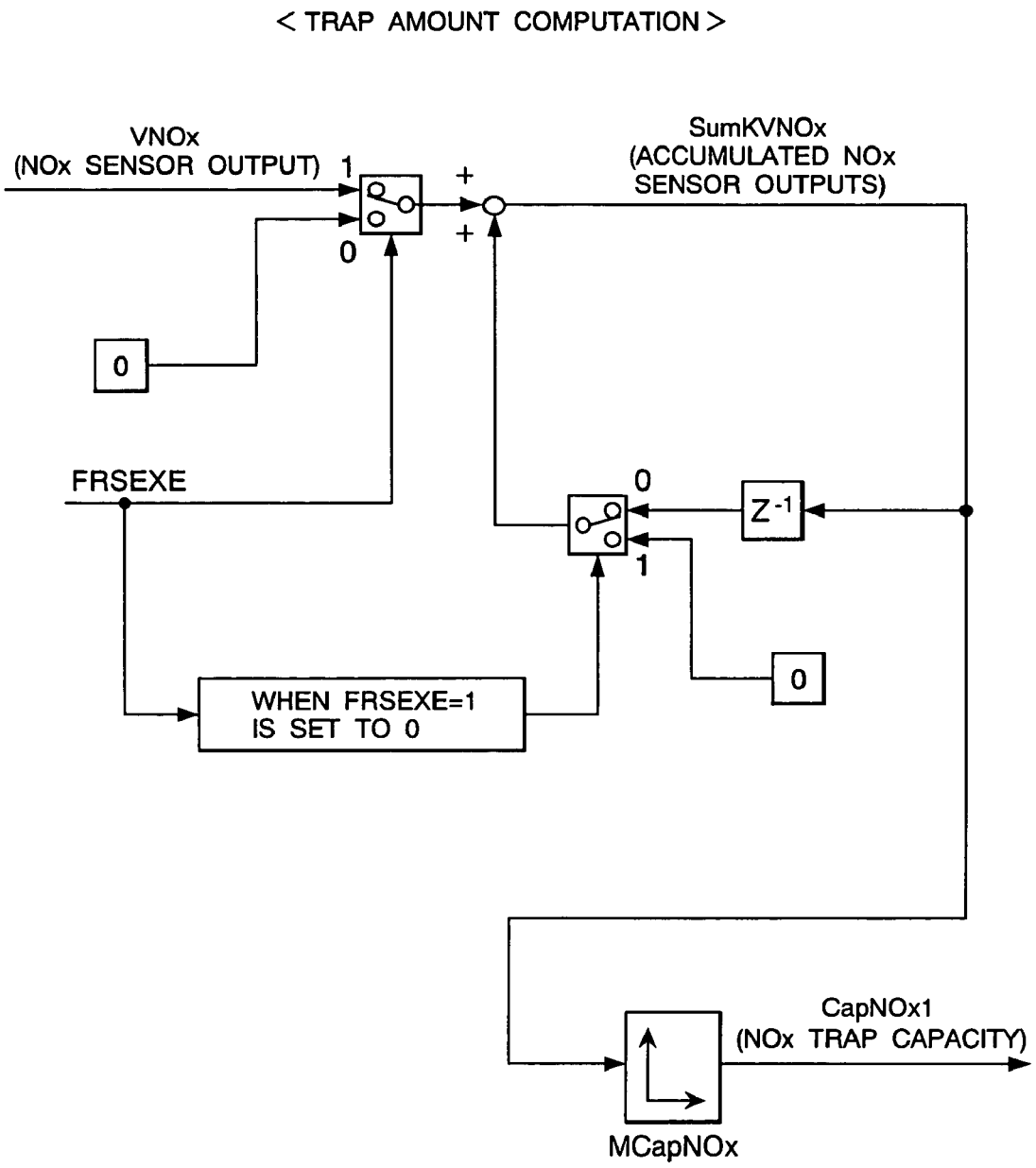
FIG. 28 is a Diagram showing the trap volume computing section in the embodiments 3 and 4.

15. Trap Amount Computing Section (FIG. 28)

Figure 29:
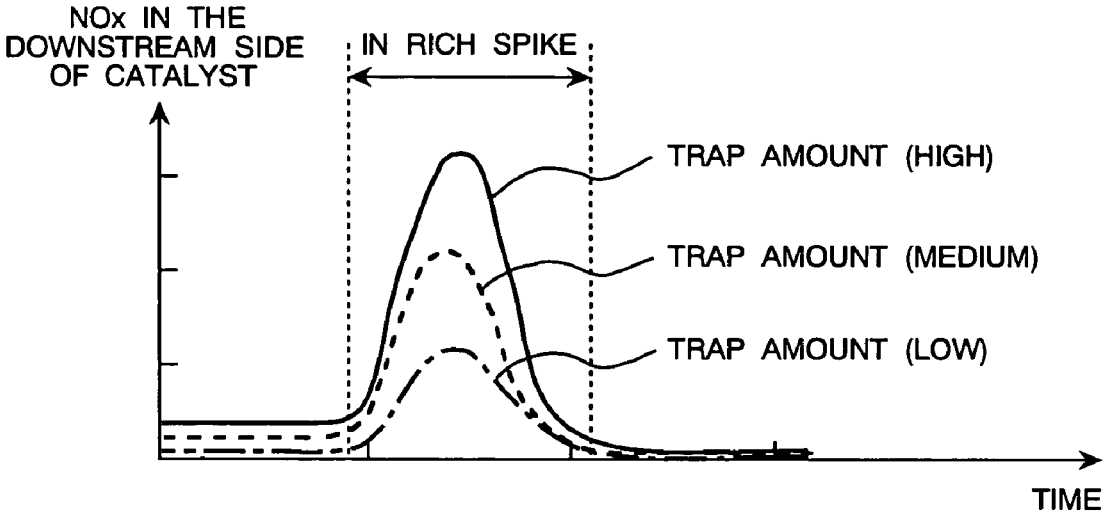
FIG. 29 is a Diagram showing the principle of the trap volume computation in the embodiment 3.

In this block, the NOx amount trapped in the NOx trap catalyst in the lean operation is computed using the NOx sensor output. To be concrete, the NOx sensor output VNOx in the rich spike operation (that is, at the time when FRSEXE=1 applies) is integrated and then converted on the map MCapNOx, and the converted result is set as the NOx trap capacity CapNOx1. This processing utilizes a fact that, in the rich spike operation, the unpurified NOx amount discharged in the downstream side of the NOx catalyst correlates to the trapped NOx volume as shown in FIG. 29.

(Embodiment 4)

In this embodiment, an engine control system according to claims 2 and 7 is described hereunder.

FIG. 8 is an engine control system diagram, which is the same system diagram as in the embodiment 1, and so no additional explanation is made. FIG. 9 shows the inside of the control unit 16, which is the same as in the embodiment 1, and so no additional explanation is made. FIG. 10 is a block diagram of the total control, which is the same as in the embodiment 1, and so no additional explanation is made. Detailed description on each control block is given hereunder.

1. Target Torque Computing Section (FIG. 11)

As shown in FIG. 11. It is the same as in the embodiment 1, and so no additional explanation is given.

2. Fuel Injection Quantity Computing Section (FIG. 12)

As shown in FIG. 12. It is the same as in the embodiment 1, and so no additional explanation is given.

3. Fuel Injection Quantity Correcting Section (FIG. 13)

As shown in FIG. 13. It is the same as in the embodiment 1, and so no additional explanation is given.

4. Target Air Flow Rate Computing Section (FIG. 14)

As shown in FIG. 14. It is the same as in the embodiment 1, and so no additional explanation is given.

5. Actual Air Flow Rate Computing Section (FIG. 15)

As shown in FIG. 15. It is the same as in the embodiment 1, and so no additional explanation is given.

6. Target Throttle Opening Computing Section (FIG. 16)

As shown in FIG. 16. It is the same as in the embodiment 1, and so no additional explanation is given.

7. Throttle Opening Controlling Section (FIG. 17)

As shown in FIG. 17. It is the same as in the embodiment 1, and so no additional explanation is given.

8. Ignition Timing Computing Section (FIG. 18)

As shown in FIG. 18. It is the same as in the embodiment 1, and so no additional explanation is given.

9. Fuel Injection Timing Computing Section (FIG. 19)

As shown in FIG. 19. It is the same as in the embodiment 1, and so no additional explanation is given.

10. Target Equivalent Ratio Computing Section (FIG. 20)

As shown in FIG. 20. It is the same as in the embodiment 1, and so no additional explanation is given.

11. Rich Spike Flag Computing Section (FIG. 30)

Figure 30:
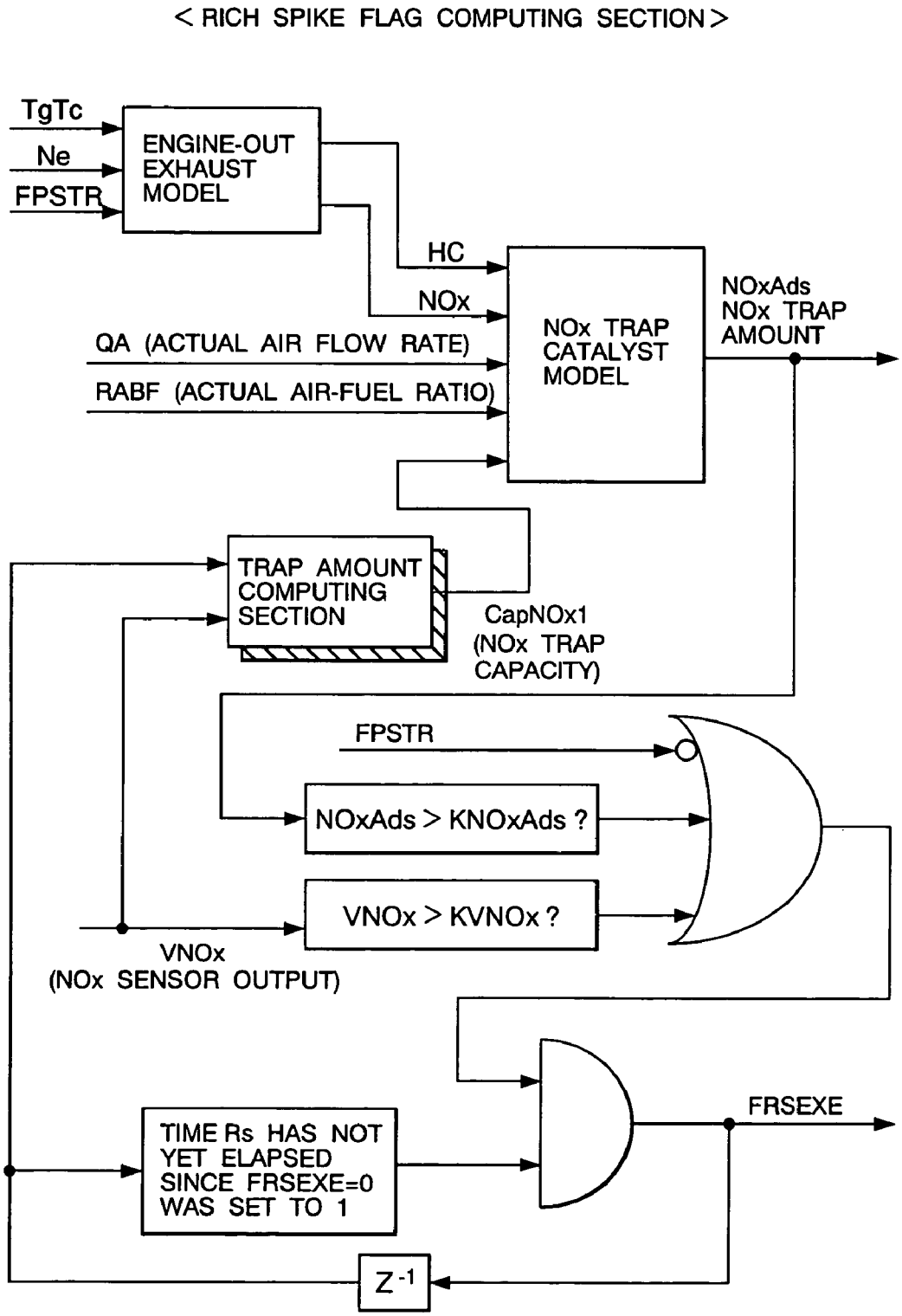
FIG. 30 is a Diagram showing the rich spike flag computing section in the embodiment 4.

As shown in FIG. 30. As compared to the rich spike flag computing section in the embodiment 3, the NOx trap capacity CapNOx1 is inputted into the NOx trap catalyst model.

12. Engine-out Exhaust Model (FIG. 22)

As shown in FIG. 22. It is the same as in the embodiment 1, and so no additional explanation is given.

13. NOx Trap Catalyst Model (FIG. 31)

Figure 31:
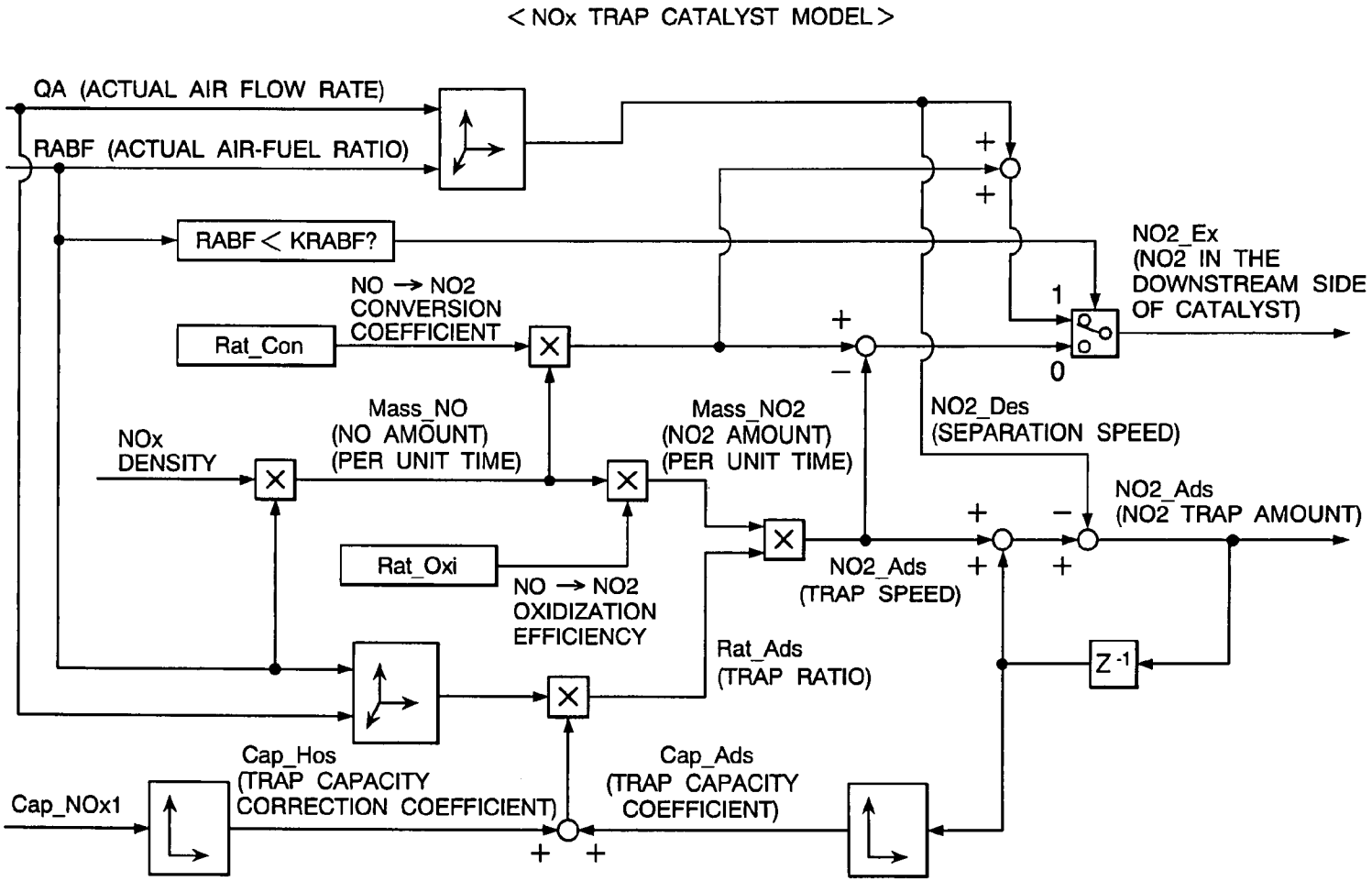
FIG. 31 is a Diagram showing the NOx trap catalyst model in the embodiment 4.

As shown in FIG. 31. As compared to the NOx trap catalyst model in the embodiments 1 to 3, a function for correcting the trap capacity coefficient Cap_Ads with the trap capacity correction coefficient Cap_Hos is added. This is employed so that the trap capacity of the NOx catalyst detected online, as explained in the embodiment 3, is utilized in the online tuning and reflected to the model.

14. RHOS Computing Section (FIG. 24)

As shown in FIG. 24. It is the same as in the embodiment 1, and so no additional explanation is given.

15. Absorbing Volume Computing Section (FIG. 28)

As shown in FIG. 28. It is the same as in the embodiment 3, and so no additional explanation is given.

(Embodiment 5)

Another embodiment is described hereunder, referring to an engine control system according to claims 2 and 7.

FIG. 8 is an engine control system diagram, which is the same system diagram as in the embodiment 1, and so no additional explanation is made. FIG. 9 shows the inside of the control unit 16, which is the same as in the embodiment 1, and so no additional explanation is made. FIG. 10 is a block diagram of the total control, which is the same as in the embodiment 1, and so no additional explanation is made. Detailed description on each control block is given hereunder.

1. Target Torque Computing Section (FIG. 11)

As shown in FIG. 11. It is the same as in the embodiment 1, and so no additional explanation is given.

2. Fuel Injection Quantity Computing Section (FIG. 12)

As shown in FIG. 12. It is the same as in the embodiment 1, and so no additional explanation is given.

3. Fuel Injection Quantity Correcting Section (FIG. 13)

As shown in FIG. 13. It is the same as in the embodiment 1, and so no additional explanation is given.

4. Target Air Flow Rate Computing Section (FIG. 14)

As shown in FIG. 14. It is the same as in the embodiment 1, and so no additional explanation is given.

5. Actual Air Flow Rate Computing Section (FIG. 15)

As shown in FIG. 15. It is the same as in the embodiment 1, and so no additional explanation is given.

6. Target Throttle Opening Computing Section (FIG. 16)

As shown in FIG. 16. It is the same as in the embodiment 1, and so no additional explanation is given.

7. Throttle Opening Controlling Section (FIG. 17)

As shown in FIG. 17. It is the same as in the embodiment 1, and so no additional explanation is given.

8. Ignition Timing Computing Section (FIG. 18)

As shown in FIG. 18. It is the same as in the embodiment 1, and so no additional explanation is given.

9. Fuel Injection Timing Computing Section (FIG. 19)

As shown in FIG. 19. It is the same as in the embodiment 1, and so no additional explanation is given.

10. Target Equivalent Weight Ratio Computing section (FIG. 20)

As shown in FIG. 20. It is the same as in the embodiment 1, and so no additional explanation is given.

11. Rich Spike Flag Computing Section (FIG. 32)

Figure 32:
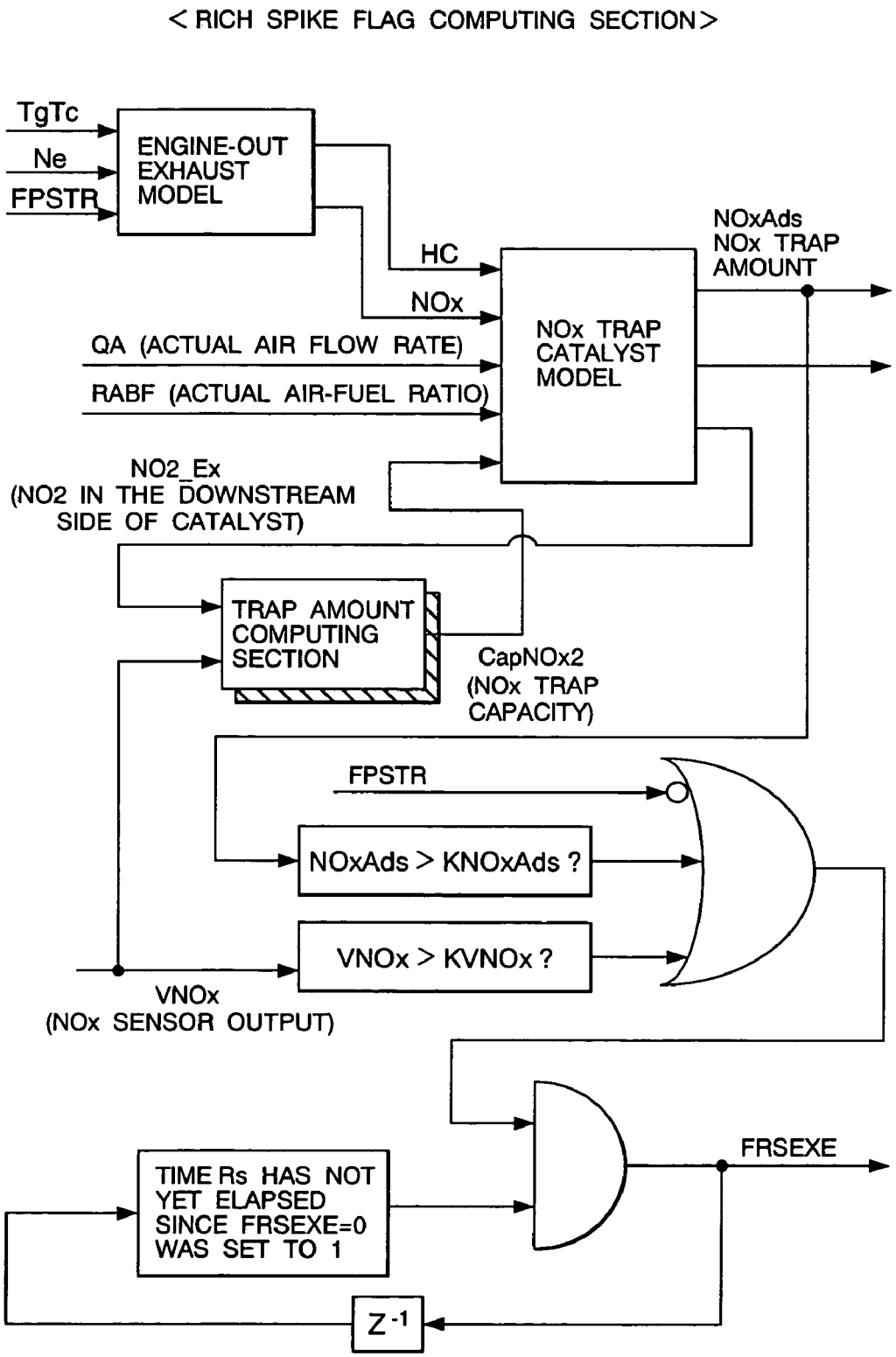
FIG. 32 is a Diagram showing the rich spike flag computing section in the embodiment 5.

As shown in FIG. 32. As compared to the rich spike flag computing section in the embodiment 3, the NOx trap capacity CapNOx2 is inputted into the NOx trap catalyst model. Computation of CapNOx2 will be described later.

12. Engine-Out Exhaust Model (FIG. 22)

As shown in FIG. 22. It is the same as in the embodiment 1, and so no additional explanation is given.

13. NOx Trap Catalyst Model (FIG. 33)

Figure 33:
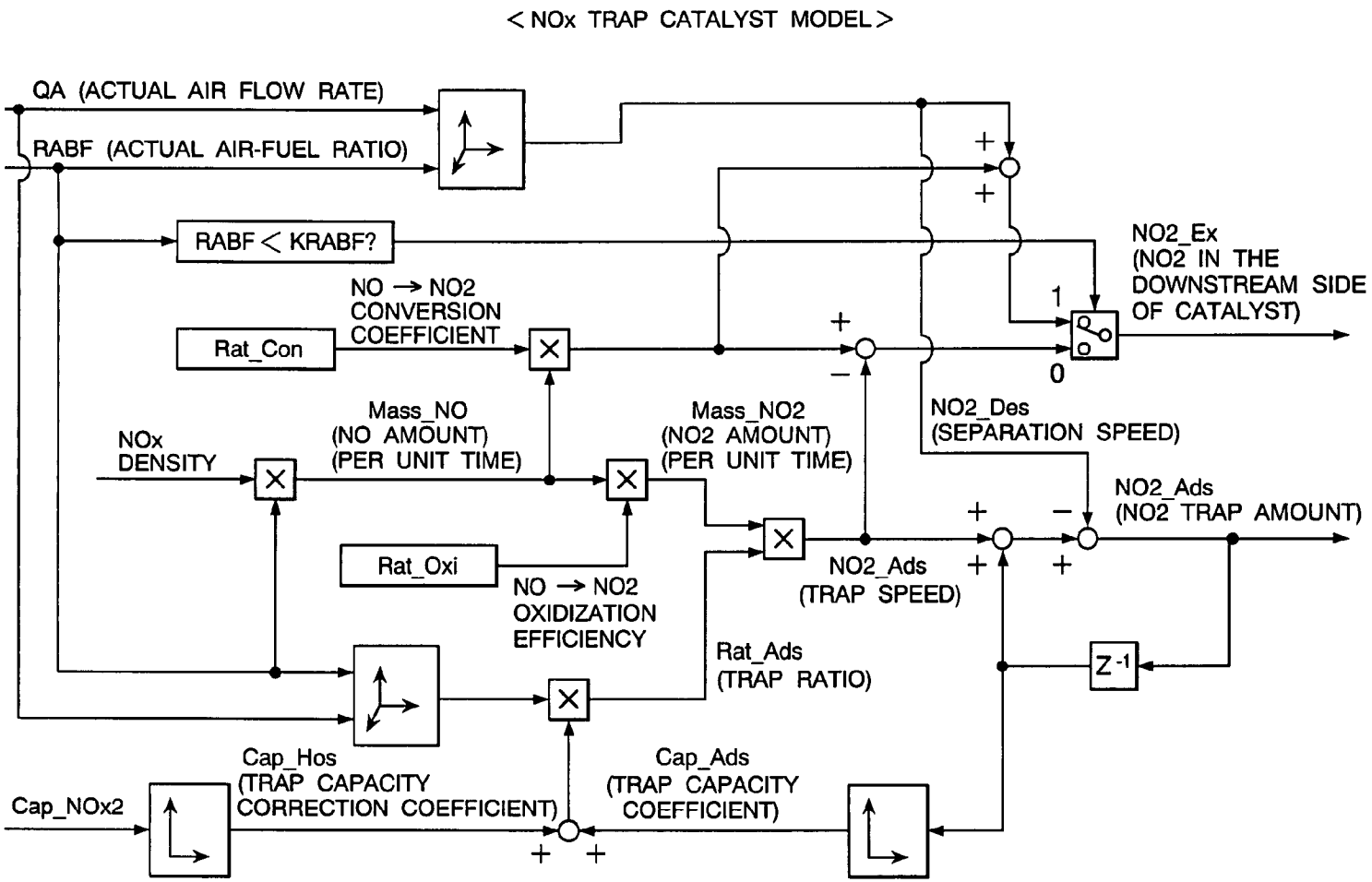
FIG. 33 is a Diagram showing the NOx trap catalyst model in the embodiment 5.

As shown in FIG. 33. As compared to the NOx trap catalyst model in the embodiment 4, it is a difference that the trap capacity correction coefficient Cap_Hos is obtained by referring Cap_NOx2 to the map.

14. RHOS Computing Section (FIG. 24)

As shown in FIG. 24. It is the same as in the embodiment 1, and so no additional explanation is given.

Figure 34:
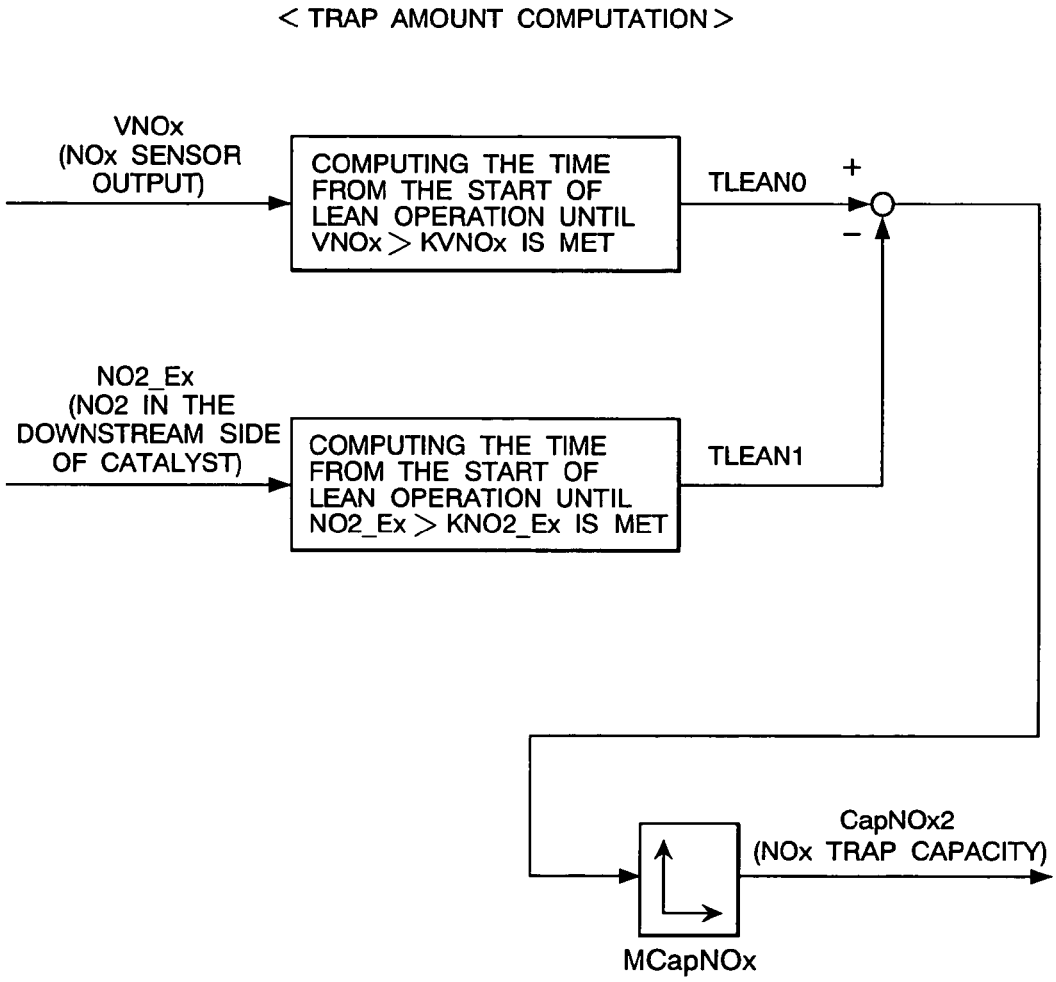
FIG. 34 is a Diagram showing the trap volume computing section in the embodiment 5.

15. Trap Volume Computing Section (FIG. 34)

In this block, Cap_NOx2 is computed. To be concrete, NOx in the downstream of the NOx trap catalyst computed by the model is compared with that in the downstream side of the NOx trap catalyst detected by the NOx sensor, and the difference is the trap capacity Cap_NOx2. For example, if the trap capacity decreases, it happens that the NOx sensor output exceeds the threshold KVNOx much earlier than the NOx in the downstream of the catalyst estimated by the model exceeds the threshold KNO2_Ex. With this phenomenon, change in the characteristic of the catalyst is detected.

While a method of estimating the trap capacity is described in each embodiment 4 and 5, it is additionally noted that use of the two different methods together enables to further improve the precision. Besides, it is also noted that, for computing the corrected equivalent weight ratio RHOS for the rich spike operation, the method in the embodiment 2 is applicable to the embodiments 3 to 5.

EFFECTS OF THE INVENTION

According to the present invention, in a lean-burn engine equipped with NOx trap catalyst, the rich spike start timing and rich spike amount of the NOx trap catalyst can be optimized, and accordingly exhaust can be reduced.

What is claimed is:

1. An engine control system for a combustion engine, comprising:

a NOx trap catalyst provided in an exhaust pipe of said engine to trap NOx by absorption or storage in an oxidation atmosphere and emit NOx in a reduction atmosphere;

a NOx sensor located in the downstream of said NOx trap catalyst to detect an amount of NOx in exhaust;

a NOx trap catalyst model for estimating a NOx amount trapped in said NOx trap catalyst;

a device that starts a rich spike control of said engine based on the NOx amount estimated by said NOx trap catalyst model; and a tuning device that tunes a parameter of said NOx trap catalyst model based on the output of the NOx sensor while the engine is in operation.

2. The engine control system according to claim 1, wherein said NOx trap catalyst model estimates the NOx amount trapped in said NOx trap catalyst and an NOx amount in the downstream of said NOx trap catalyst based on exhaust components and an air flow rate.

3. An engine control system for a combustion engine, comprising:

a NOx trap catalyst provided in the exhaust pipe of said engine to trap NOx by absorption or storage in an oxidation atmosphere and emit NOx in a reduction atmosphere;

a NOx sensor located in the downstream of said NOx trap catalyst to detect NOx components in exhaust;

a NOx trap catalyst model for estimating a NOx amount trapped in said NOx trap catalyst; and a device that controls the operating condition of said engine based on outputs of said NOx trap catalyst model and said NOx sensor, wherein said NOx trap catalyst model comprises:

a means for obtaining the air-fuel ratio and the intake air flow rate of said engine directly or indirectly;

a means for obtaining the predetermined NOx density in the upstream side of said NOx trap catalyst based on the operating condition of said engine;

a means for obtaining the NOx amount flowing into said NOx trap catalyst from said NOx density and said intake air flow rate;

a means for obtaining the predetermined NOx trap ratio based on said air-fuel ratio and said intake air flow rate;

a means for obtaining the NOx trap speed from said NOx amount inflowing into said NOx trap catalyst and said NOx trap ratio;

a means for obtaining the predetermined NOx release speed in said NOx trap catalyst based on said air-fuel ratio and said intake air flow rate; and a means for estimating the NOx trap amount based on the difference between said NOx trap speed and NOx release speed.

4. The engine control system according to claim 3, wherein said NOx trap catalyst model replaces said NOx trap ratio with a new NOx trap ratio based on a correction coefficient obtained from the estimated NOx trap amount.

5. The engine control system according to claim 4, wherein the newly obtained NOx trap ratio is corrected according to the output from said NOx sensor located in the downstream of said NOx trap catalyst.

6. The engine control system according to claim 3, it is equipped with a tuning device that tunes on-line the NOx trap ratio obtained at said NOx trap catalyst model based on the output of the NOx sensor.

7. The engine control system according to claim 1, wherein a rich spike control is started when the NOx trap amount in said NOx trap catalyst, which is computed by said NOx trap catalyst model, or the output of said NOx sensor exceeds a specified value.

8. The engine control system according to claim 1, wherein the rich amount or rich time required for said rich spike is determined based on the NOx trap amount in said NOx trap catalyst estimated by said NOx trap catalyst model.

9. The engine control system according to claim 3, wherein the NOx trap ratio is corrected based on the NOx amount detected in the downstream side of said NOx trap catalyst during the rich spike of said engine.

10. The engine control system according to claim 6, wherein the NOx trap ratio representing a NOx trap capacity is provided in said NOx trap catalyst model, and said tuning device adjusts the NOx trap ratio in said model based on the estimated NOx trap amount.

11. The engine control system according to claim 1, wherein the NOx trap catalyst model estimates the NOx amount trapped in said NOx trap catalyst during lean-burn operation, and the tuning device tunes the parameter of said NOx trap catalyst model during a rich spike of said engine.

12. The engine control system according to claim 11, wherein the tuning device computes a NOx amount trapped in the NOx trap catalyst in the lean operation based on the output of the NOx sensor using a map during the rich spike after the lean operation, and tunes the parameter of said NOx trap catalyst model based on a result of comparing the NOx amount estimated by the NOx trap catalyst model and the NOx amount computed by the map.

* * * * *